US010422602B2

(12) United States Patent
Theiss

(10) Patent No.: US 10,422,602 B2
(45) **Date of Patent: *Sep. 24, 2019**

(54) SEAR SYSTEM FOR A FIREARM

(71) Applicant: Apex Tactical Specialties, Inc., Peoria, AZ (US)

(72) Inventor: Matthew Theiss, Glendale, AZ (US)

(73) Assignee: Apex Tactical Specialties, Inc., Peoria, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/015,188

(22) Filed: Jun. 22, 2018

(65) Prior Publication Data

US 2018/0306541 A1 Oct. 25, 2018

Related U.S. Application Data

(63) Continuation of application No. 15/445,873, filed on Feb. 28, 2017, now Pat. No. 10,030,927.

(51) Int. Cl.

| | |
|---|---|
| ***F41A 19/12*** | (2006.01) |
| ***F41C 3/00*** | (2006.01) |
| ***F41A 17/72*** | (2006.01) |

(52) U.S. Cl.

CPC ..... *F41A 19/12* (2013.01); *F41A 17/72* (2013.01); *F41C 3/00* (2013.01)

(58) Field of Classification Search

CPC ..... F41A 19/12; F41C 3/00

See application file for complete search history.

(56) References Cited

U.S. PATENT DOCUMENTS

| | | | |
|---|---|---|---|
| 2,341,299 | A | 2/1944 | Sweany |
| 2,387,788 | A | 10/1945 | Wiles |
| 2,775,836 | A | 1/1957 | Emerson |
| 2,984,037 | A | 5/1961 | Wilhelm |
| 3,011,282 | A | 12/1961 | Sefried, II |
| 3,103,758 | A | 9/1963 | Wilhelm |
| 3,167,877 | A | 2/1965 | Jungeling |
| 3,662,483 | A | 5/1972 | Seecamp |
| 4,433,610 | A | 2/1984 | Tatro |
| 4,646,619 | A | 3/1987 | Sokolovsky |
| 4,908,970 | A | 3/1990 | Bell |
| 5,388,362 | A | 2/1995 | Melcher |
| 5,400,537 | A | 3/1995 | Meller |
| 5,826,362 | A | 10/1998 | Lyons |
| 5,857,280 | A | 1/1999 | Jewell |
| 6,164,001 | A | 12/2000 | Lee |

(Continued)

OTHER PUBLICATIONS

Restriction Requirement for U.S. Appl. No. 13/529,803 dated Mar. 27, 2014.

Notice of Allowance for U.S. Appl. No. 13/529,803 dated Jun. 16, 2014.

Lee; U.S. Appl. No. 13/529,803, filed Jun. 21, 2012.

Lee; U.S. Appl. No. 14/489,457, filed Sep. 17, 2014.

(Continued)

*Primary Examiner* — Bret Hayes

(74) *Attorney, Agent, or Firm* — Fitch, Even, Tabin & Flannery LLP

(57) ABSTRACT

A firing mechanism for a firearm is provided for reducing maximum trigger pull weight attributable to a sear and for reducing trigger pre-travel and over-travel distances. The firing mechanism includes a sear actuator with a trigger engagement leg that engages with a trigger bar at a reduced trigger travel distance. The firing mechanism also includes an increased trigger bar contact distance, thus reducing trigger pull weight.

5 Claims, 9 Drawing Sheets

(56) References Cited

U.S. PATENT DOCUMENTS

| | | | | |
|---|---|---|---|---|
| 6,382,200 | B1 | 5/2002 | Levkov | |
| D504,168 | S * | 4/2005 | McCormick | D22/108 |
| 8,250,799 | B2 | 8/2012 | Duperry | |
| D771,767 | S * | 11/2016 | Niswander | D22/108 |
| 10,030,927 | B1 * | 7/2018 | Theiss | F41A 19/12 |
| 2003/0070342 | A1 | 4/2003 | Baker | |
| 2003/0145503 | A1 | 8/2003 | Orr | |
| 2006/0101693 | A1 | 5/2006 | Langlotz | |
| 2006/0248772 | A1 | 11/2006 | Curry | |
| 2007/0245615 | A1 | 10/2007 | Karagias | |
| 2009/0178322 | A1 | 7/2009 | Dye | |
| 2013/0340309 | A1 | 12/2013 | Lee | |
| 2015/0253094 | A1 | 9/2015 | Reynolds | |
| 2015/0292828 | A1 | 10/2015 | Nebeker | |
| 2016/0084600 | A1 | 3/2016 | Siddle | |

OTHER PUBLICATIONS

Non-Final Office Action for U.S. Appl. No. 14/489,457 dated May 18, 2016.
Notice of Allowance for U.S. Appl. No. 14/489,457 dated Sep. 23, 2016.
Notice of Allowance for U.S. Appl. No. 14/489,457 dated Mar. 16, 2017.
Non-final office action for U.S. Appl. No. 15/394,793 dated Jan. 24, 2017.
Lee; U.S. Appl. No. 15/394,793, filed Dec. 29, 2016.
Notice of Allowance for U.S. Appl. No. 15/394,793 dated Apr. 19, 2017.
Non-Final Office Action for U.S. Appl. No. 15/445,873 dated Nov. 7, 2017.
Notice of Allowance for U.S. Appl. No. 15/445,873 dated Mar. 23, 2018.
Theiss; U.S. Appl. No. 15/445,873, filed Feb. 28, 2017.

* cited by examiner

SEAR SYSTEM FOR A FIREARM

This application is a continuation of U.S. application Ser. No. 15/445,873, filed Feb. 28, 2018, for SEAR SYSTEM FOR A FIREARM, which is incorporated in its entirety herein by reference.

BACKGROUND OF THE INVENTION

1. Field of the Invention

The present invention relates generally to firearms, and more specifically to firing mechanisms for a firearm.

2. Discussion of the Related Art

Firearms, as are generally understood in the art, typically have a trigger with certain trigger characteristics. These characteristics may include a pre-travel distance, an engagement distance, an over-travel distance, and a reset distance. Additionally, while a trigger is traveling between these travel segments, trigger pull weights, or forces, are exerted in opposition to the general direction of travel of the trigger (except for a post-firing reset travel, wherein the force is generally in the direction of travel). Each travel segment may have a different trigger pull weight (i.e., level of force). This aids a user in determining by feel where a trigger is located within its general travel from a resting position through an engagement or firing position to a post-firing position, back to a reset point, and finally back to a resting position.

Users of firearms, and handguns in particular, often have differing preferences for the feel of a trigger. The feel can be affected by altering one, some, or all of the travel distances and/or altering one, some, or all of the pull weights associated with each travel segment. A trend exists towards a preference for a shorter pre-travel distance. A similar trend exists with respect to shorter over-travel and reset travel distances. These travel distances, alone or in combination, can affect how a user grips the firearm and how their grip can change throughout the travel of the trigger, which can ultimately affect accuracy.

Similarly, a trend exists toward a preference for lowered maximum trigger pull weights. Variations on factors affecting trigger pull weight are possible, but implementing certain variations can often affect other performance aspects of a firearm given current configurations.

One such aspect of concern is that firearms often suffer from a phenomenon called "sear flutter." This can render a firearm, and particularly semi-automatic firearms, useless until further action is taken to remedy the problem at the time of use of the firearm. To greatly reduce the probability of a sear flutter incident, certain factors of the firearm may be altered. However, many of the components and factors affecting sear flutter also affect maximum trigger pull weight in an opposing manner. For example, if a factor is altered so that the probability of sear flutter is reduced, maximum trigger pull weight may increase greatly.

Additionally, currently available configurations of firearm trigger and trigger assemblies can produce other problems. One problem in particular is that trigger attachment pins can loosen and eventually cause the trigger to become detached during use, thereby rendering the firearm useless until the part is ultimately repaired.

U.S. Pat. No. 8,863,425, incorporated in its entirety herein by reference, disclosed a sear for controllably releasing the firing pin of a semiautomatic handgun upon actuation of a trigger bar of a trigger assembly of the handgun.

SUMMARY OF THE INVENTION

In one embodiment, the invention can be characterized as a sear actuator for a firearm comprising: an annular portion configured to rotate about a sear fulcrum axis of the firearm, wherein the sear actuator rotates between a first pivotal position and a second pivotal position; a trigger engagement leg coupled to the annular portion and including an end trigger bar contact surface laterally offset from the annular portion and configured to be engaged by a trigger bar of the firearm when a trigger of the firearm is pulled by a user, whereby rearward movement of the trigger bar when the trigger bar contact surface is engaged by the trigger bar rotates the sear actuator from the first pivotal position to the second pivotal position; and a lower tooth extending radially outward from the annular portion and including an upward sear actuation surface configured to contact a camming surface of a sear of the firearm, whereby rotation of the sear actuator from the first pivotal position to the second pivotal position results in rotation of the sear, wherein upon installation of the sear actuator in the firearm the firearm produces a maximum pull weight attributable to the sear that is approximately linearly related to a sear spring weight as a function of a line having a y-intercept of less than 1.5.

In another embodiment, the invention can be characterized as a method of modifying a firearm comprising: providing a sear actuator comprising: an annular portion configured to rotate about a sear fulcrum axis of the firearm, wherein the sear actuator rotates between a first pivotal position and a second pivotal position; a trigger engagement leg coupled to the annular portion and including an end trigger bar contact surface laterally offset from the annular portion and configured to be engaged by a trigger bar of the firearm when a trigger of the firearm is pulled by a user, whereby rearward movement of the trigger bar when the trigger bar contact surface is engaged by the trigger bar rotates the sear actuator from the first pivotal position to the second pivotal position; and a lower tooth extending radially outward from the annular portion and including an upward sear actuation surface configured to contact a camming surface of a sear of the firearm, whereby rotation of the sear actuator from the first pivotal position to the second pivotal position results in rotation of the sear, wherein upon installation of the sear actuator in the firearm the firearm produces a maximum pull weight attributable to the sear that is approximately linearly related to a sear spring weight as a function of a line having a having a y-intercept of less than 1.5.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
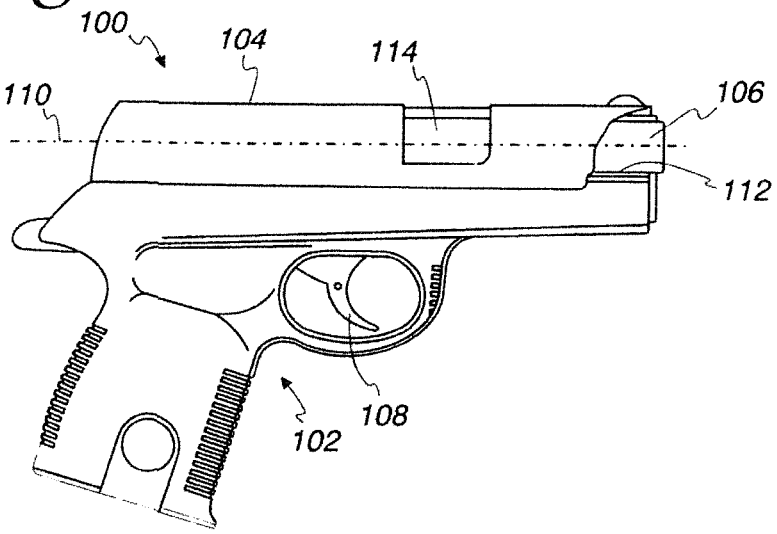
Fig. 1 PRIOR ART
FIG. 1 is an example of a firearm in accordance with various embodiments.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Moreover, many references are made throughout this specification to approximate values and ranges. The terms "approximate" or "about" as used herein are meant simply to account for various tolerances and reasonable variances as may exist in manufacturing and testing procedures as are readily understood by those having skill in the art. For example, reference to an approximate value may inherently include a tolerance or variance of 0.10%, 1%, 5%, 10%, or anything in between, as would be deemed appropriate by one having skill in the relevant art with regard to the specific item or concept to which the value or range pertains.

Referring first to FIG. 1, an example of a firearm 100 in accordance with various embodiments is shown. By one approach, the firearm 100 is a semiautomatic handgun or pistol, though the teachings disclosed herein may be applied to any type of firearm 100. Specifically, the firearm 100 comprises a frame 102, a slide 104, a barrel 106, and a trigger 108. The barrel 106 is disposed at the front aperture of the slide 104 and is cooperatively linked therewith, and, together with the slide 104, defines a longitudinal firing axis 110. The barrel 106 has a rearward end adapted for receiving an ammunition cartridge. A trigger 108 is pivotally mounted optionally to the frame 102 to actuate a firing mechanism 200 (FIG. 2) to fire the firearm 100. Often, the frame 102 is fabricated of a high-impact polymer material, metal, a combination of polymer and metal, or the like. The firing mechanism or means 200 is provided for, at least in part, discharging a round of ammunition upon actuation of the trigger 108.

The slide 104 is fitted to opposingly-positioned rails 112 of the frame 102 to effect the reciprocal movement of the slide 104 along the longitudinal firing axis 110. The rails 112 extend along the underside of the slide 104 in the longitudinal direction and are cooperative with the frame 102 to allow the cycling of the slide 104 between forward (battery) and rearward (retired) positions. The slide 104 further includes a firing chamber, an ejection port 114, and an ejection mechanism that provides for the ejection of the cartridge through the ejection port 114 upon firing the firearm 100 or upon manual cycling of the slide 104.

Figure 2:
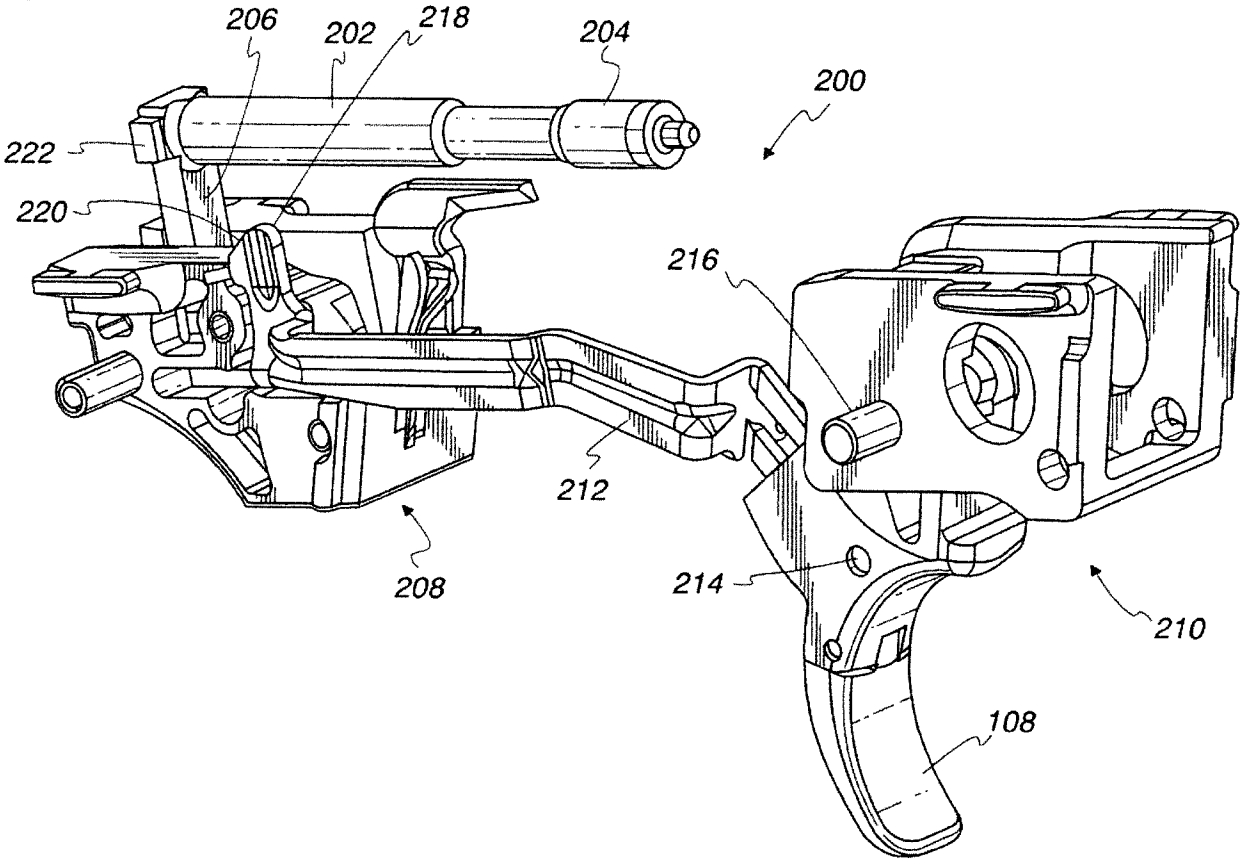
FIG. 2 is a diagram of an example firing mechanism for the firearm of FIG. 1 in accordance with various embodiments.

Referring next to FIG. 2, an example firing mechanism 200 for a firearm 100 is illustrated in accordance with at least one embodiment. The firing mechanism 200 includes a striker-type firing pin 202 having a forward firing pin portion 204 and a depending leg 206 extending down from the firing pin 202. The firing mechanism 200 also includes a sear assembly 208 that is engagable by the firing pin 202. The sear assembly 208 is operably engagable with a trigger assembly 210 that includes the trigger 108 and trigger bar 212. Upon operation of the firearm 100 (via movement of the trigger 108), a surface of the depending leg 206 selectively engages the sear assembly 208.

By some embodiments, the trigger 108 is pivotally connected to a trigger bar 212 via a trigger bar pin 214. Rearward movement of the trigger 108 causes movement of the trigger bar 212 in a predominately rearward longitudinal direction (direction "A" in FIG. 3). When the trigger 108 is actuated by being pressed in a rearward direction, the trigger 108 pivots about a trigger pin 216, thereby transmitting rearward longitudinal movement to the trigger bar 212 via the trigger bar pin 214.

Figure 3:
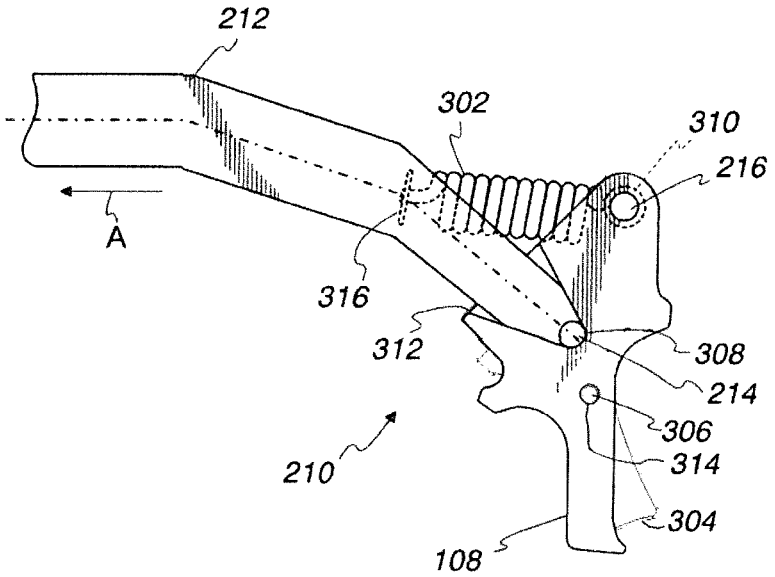
FIG. 3 is an additional depiction of a portion of the firing mechanism of FIG. 2 in accordance with various embodiments.

Referring now to FIG. 3, a depiction of a portion of a trigger assembly 210 is shown, in accordance with various embodiments. The trigger assembly 210 comprises the trigger 108, the trigger bar 212, the trigger bar pin 214, the trigger pin 216, and a trigger return spring 302. Additionally, and by at least some embodiments, the trigger 108 further comprises a trigger safety blade 304 which rotates about a trigger safety blade pin 306, a trigger bar pin opening 308, a trigger pin opening 310, a trigger bar slot 312, and a trigger safety blade pin opening 314.

As described above, the trigger bar 212 is pivotally connected to the trigger 108 by the trigger bar pin 214 through a trigger bar pin opening 308, which may be located between the trigger pin opening 310 near the top of the trigger 108 and the vertical center of the trigger 108 by at least one embodiment. Optionally, a connecting portion of the trigger bar 212 may reside in a trigger bar slot 312 disposed on the rear portion of the trigger 108, which may limit rotational movement of the trigger bar 212 about the trigger bar pin 214. Additionally, the trigger bar slot 312 may provide resistance against lateral movement or twisting of the trigger bar 212 so that play between the trigger bar 212 and the trigger 108 is greatly restricted or eliminated. Additionally, a tight fit may increase perpetuation of any vibrations relative to the movement of the trigger bar 212 through the various trigger travel stages, which may result in a cleaner or crisper experience for the user. The trigger return spring 302 extends from a trigger return spring connection point 316 on the trigger bar 212 (i.e., a holed-tab which one of the spring can connect to) to the trigger pin 216 (though other locations near or on the trigger 108 could suffice). In at least one embodiment, the trigger pin 216 comprises a groove running radially around a center portion of the trigger pin 216 such that the opposite end of the trigger return spring 302 can securely rest in the grove.

In operation, the trigger bar 212 may be biased in a forward longitudinal direction via the trigger return spring 302 or the like. As described above, when the trigger 108 is pulled in a rearward direction and resultantly rotates about the trigger pin 216, rearward longitudinal movement (labeled arrow "A") is translated to the trigger bar 212 via the trigger bar pin 214. (The movement of the trigger bar 212 is almost entirely longitudinal due to various grooves, etc, internal to the firearm which the trigger bar 212 moves in and which operate to limit the movement of the trigger bar 212 to longitudinal movement.) As the trigger bar 212 moves longitudinally rearward, the distance between the trigger return spring connection point 316 and the trigger pin 216 increases, thus stretching the trigger return spring 302 further. The trigger return spring 302, already configured to bias the trigger 108 forward, further opposes this rearward motion and exerts a force opposite the rearward motion.

Figure 4:
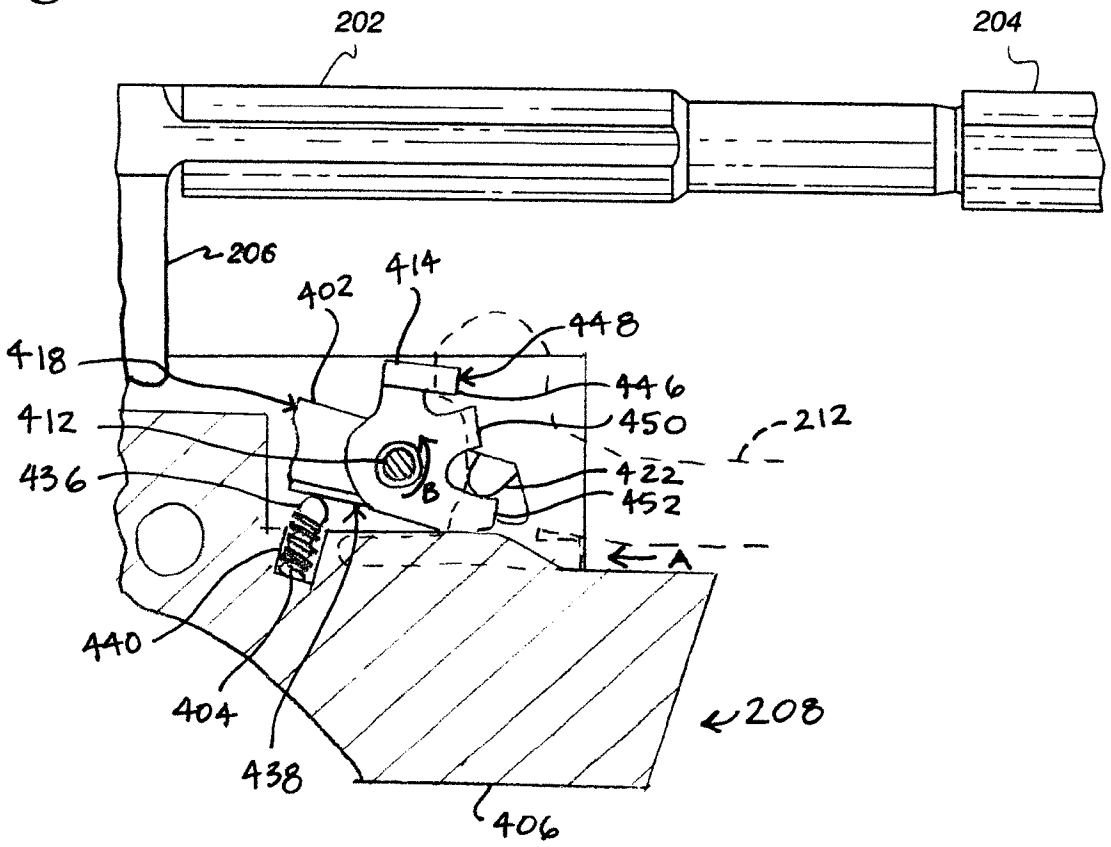
FIG. 4 is a cross-sectional view of the firearm showing a sear assembly of the firearm as may be used in the firing mechanism of FIG. 2 in accordance with various embodiments.
Figure 5:
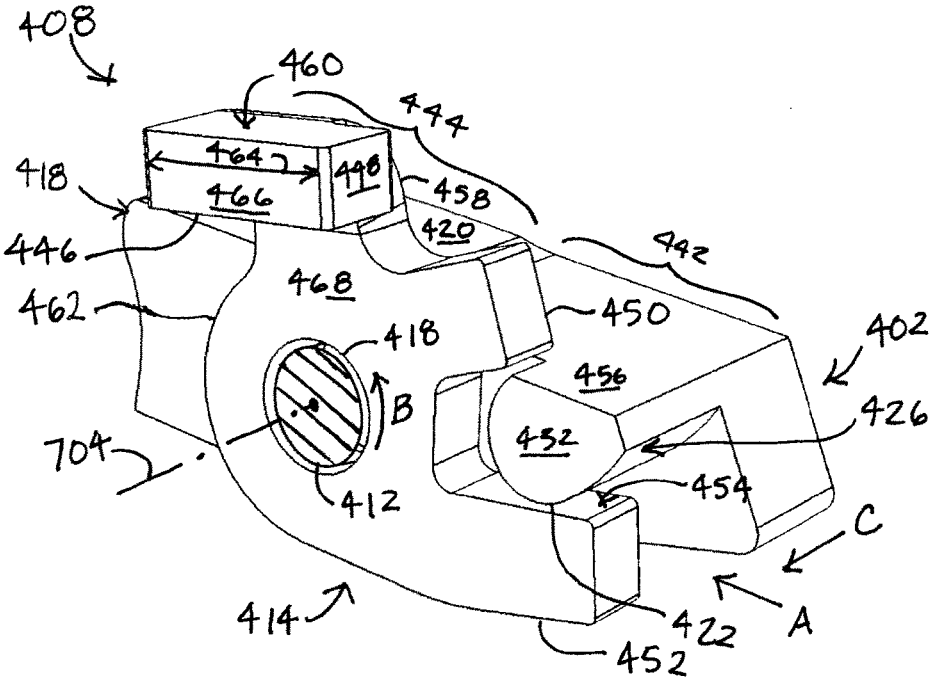
FIG. 5 is a front perspective view of a sear actuator assembly of the sear assembly of FIG. 4 in accordance with various embodiments.

Referring next to FIGS. 4 and 5, a cross-sectional view of the sear assembly 208 portion of the firearm showing a sear actuator assembly 408 within the firearm 100, and a front perspective view of the sear actuator assembly 408, respectively, are shown. In FIG. 4 the trigger bar 212 is shown dashed for clarity. FIGS. 4 and 5 are shown in a post-firing recoil position. Shown in FIGS. 4 and 5 are the firing pin 202, the depending leg 206, the sear assembly 208, the trigger bar 212, a sear 402, a sear spring 404, a sear block frame 406, a sear actuator assembly 408, a sear block frame 406, a fulcrum opening 410, a fulcrum 412, a sear actuator 414, a sear rearward surface 418, a sear top surface 420, a camming portion 422, a camming surface 426, a cam side surface 432, a sear spring plunger 436, a sear spring bore hole 440, a sear front portion 442, a sear rear portion 444, a trigger engagement leg 446, a trigger bar contact surface 448, an upper tooth 450, a lower tooth 452, and a sear actuation surface 454, a camming portion top surface 456, an actuator extension 458, an outer face 460, an annular portion 462, a trigger engagement leg length 464, and the fulcrum axis 704. Whereas FIG. 4 depicts the sear actuator assembly within the sear assembly 208, FIG. 5 depicts the sear actuator assembly 408 only to allow for greater detail and understanding. Reference below to various parts of these items may exist in FIG. 4 or FIG. 5 or both.

Figure 7:
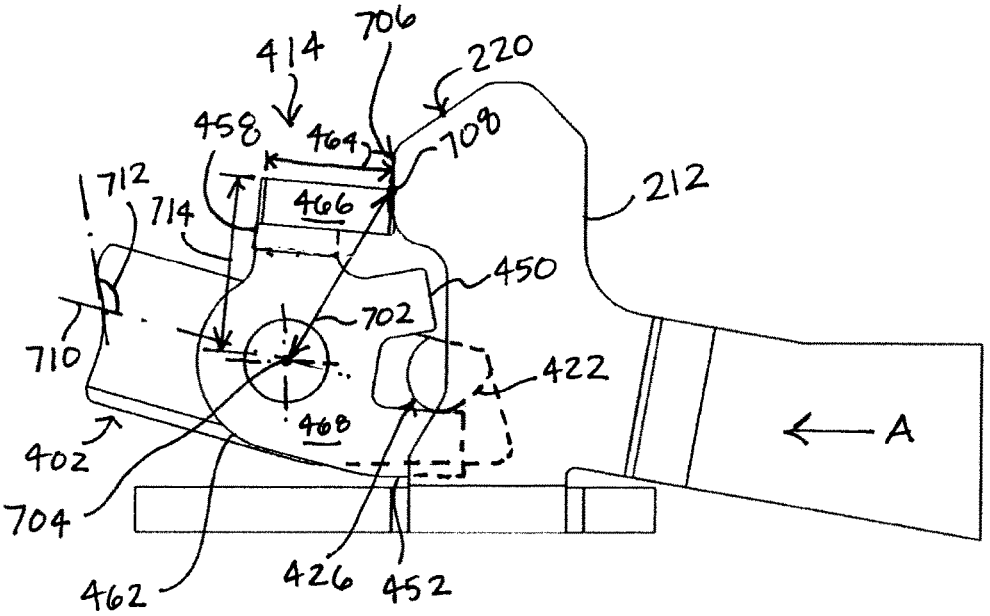
FIG. 7 is a diagram of the sear assembly of FIG. 5 and a portion of a trigger bar of the firearm in accordance with at least one embodiment.
Figure 18:
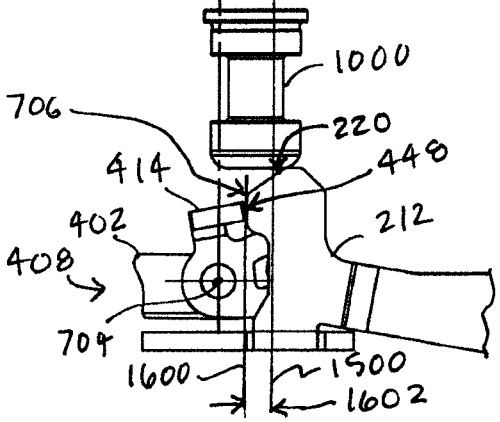
FIG. 18 is a side elevational view the sear actuator assembly, the striker block and the trigger bar of the firearm when firing of the firearm has been initiated.

The sear 402 is a generally longitudinal member having a circular sear fulcrum opening (not shown) that is substantially perpendicular to a sear longitudinal axis 710 (shown below in FIG. 7) of the sear 402. The sear fulcrum opening is aligned with the circular sear actuator fulcrum opening 410 and is configured to receive the fulcrum body 412 about which the sear 402 is pivotal between at least a first (ready) pivotal position (as shown in FIGS. 4, 5 and 7) and a second (firing) pivotal position (as shown in FIG. 18). The fulcrum 412, the fulcrum opening 410, and the sear fulcrum opening are centered on the fulcrum axis 704 about which the sear actuator 414 and the sear 402 rotate. By one embodiment, the fulcrum 412 may be located such that is effectively partitions the sear 402 into the sear front portion 442 and the rear portion 444, with the fulcrum 412 generally centrally located. The sear front portion 442 is configured to engage at least with the sear actuator 414, which in turn engages with the trigger bar 212. At least a portion of the sear rearward surface 418 of the rear portion 444 is configured to inter-engage at least the depending leg 206 of the firing pin 202. Additionally, the sear 402 may comprise a sear top surface 420 disposed at least on the rear portion 444 of the sear 402 for momentary engagement by the depending leg 206 of the firing pin 202.

The sear 402 may further comprise the camming portion 422 disposed on the sear front portion 442 and extending outward from a side of the sear 402 towards the sear actuator 414. In the present embodiment, the camming portion top surface 456 is aligned with an adjacent portion of the sear top surface 420. A lower surface of the camming portion 422 is rounded, forming a generally D-shaped member with a curved camming surface 426 of the D-shape extending generally downward. The camming surface 426 is configured to engage with the sear actuation surface 454 of the sear actuator 414 and contact the sear actuation surface 454 of the sear actuator 414 during the firing sequence. By one embodiment, the camming surface 426 has a radius between about 0.04 inches and about 0.06 inches. By an additional embodiment, the radius is approximately 0.05 inches. The sear 402 and sear actuator 414 should also provide adequate space at least directly under the camming portion 422 to allow for the trigger bar 212 to slide longitudinally under the sear 402 uninhibited by the sear 402 other than by engagement with the sear actuator 414 (which in turn engages the sear 402, as described below). By at least one embodiment, the sear 402 is manufactured or machined from metal, possibly comprising 1050 steel or A2 tool steel. Optionally, the sear 402 may further be heat-treated to decrease wear.

The sear 402 together with the sear actuator 414 comprise the sear actuator assembly 408. The sear actuator 414 includes a generally annular portion 462 including the center sear actuator fulcrum opening 410. In one embodiment an outer radius of the annular portion 462 is approximately 0.1 inches. In the present embodiment the annular portion 462 has a thickness of 0.05 inches. The sear actuator 414 is oriented such that a central axis of the annular portion 462 aligns with the fulcrum axis 704, i.e. the annular portion 462 is oriented in a generally vertical plane. The sear actuator fulcrum opening 410 is configured to receive the fulcrum 412 about which the sear actuator 414 is pivotal (i.e. the sear actuator 414 is pivotal about the fulcrum axis 704). In one embodiment the sear actuator fulcrum opening 410 has a diameter of approximately 0.093 inches. The sear actuator 414 includes the arcuate actuator extension 458 extending first generally upwards from the annular portion 462 and then arcing away from the sear 402 (when the sear actuator 414 is installed on the fulcrum 412) at an angle of approximately 90 degrees. In one embodiment, an outer face distance 714, as shown below in FIG. 7 and measured from the fulcrum axis 704 to a furthest radial distance of the extension 458, is approximately 0.2 inches.

The trigger engagement leg 446 of the sear actuator 414 is a longitudinal member coupled to the actuator extension 458 with the leg outer face 460 coincident with the furthest radial distance of the actuator extension 458, i.e. the outer face distance 714 is also the distance from the fulcrum axis 704 to the outer face 460, as shown in FIG. 7. The trigger engagement leg 446 extends generally forward towards away from the sear 402, is offset laterally from the annular portion 462. In one embodiment, a normal distance between an annular portion face 468 distal to the sear 402 and a trigger engagement leg face 466 distal to the sear 402 and generally parallel to the sear actuator face 468 is approximately 0.1 inches. A forward end of the trigger engagement leg 446 includes the generally flat and near vertical (when installed in the firearm) trigger bar contact surface 448. In the embodiment shown, the near vertical trigger bar contact surface 448 is approximately 10 degrees from vertical when the sear actuator 414 is at rest. In the present embodiment, the trigger bar contact surface is rectangular and approximately 0.06 inches by 0.05 inches. An overall leg length 464 is 0.17 inches in one embodiment of the present invention. The lateral offset of the trigger engagement leg 446 from the annular portion 462 is configured such that when the sear actuator assembly 408 is installed in the firearm 100 and the sear actuator 108 is pulled back, an upper portion of the trigger bar 212 slides in front of lower tooth 452 and then engages the trigger bar contact surface 448 (as shown below in FIG. 7).

The sear actuator 414 also includes the lower tooth 452 extending generally horizontally outward toward the trigger 108 at a lower front portion of the annular portion 462, and the upper tooth 450 extending outward from an upper portion of the annular portion 462 between the lower tooth 452 and the actuator extension 458. Both the upper tooth 450 and the lower tooth 452 have the same thickness and are in the same plane as the annular portion 462. The upper tooth 450 extends outward at an angle slightly higher than horizontal. The upper tooth 450 is configured to limit trigger 108 travel necessary for reset of the firearm 100 by aligning the sear actuator 414 movement with that of the sear 402. The lower tooth 452 includes the sear actuation surface 454 on the upper surface of the lower tooth 452. A distal end of the upper tooth 450 is located approximately 0.168 inches from the fulcrum axis 704, and a distal end of the lower tooth 452 is located approximately 0.223 inches from the fulcrum axis 704. In one embodiment, an upper face of the lower tooth 452 is angled 10 degrees from horizontal, and an angle between the upper face of the lower tooth 452 and a lower face of the upper tooth 450 is approximately 15 degrees. An angle between a lower face of the lower tooth 452 is approximately 15 degrees, i.e. the lower tooth 452 tapers slightly from base to end.

In the present embodiment, the sear actuator 414 is integrally formed, for example machined or bent from a single piece of steel. In one embodiment, the sear actuator 414 is comprised of type 1050 steel type or 420 stainless steel. In some embodiments the sear actuator 414 may be treated by melonite processing.

Referring again to FIGS. 4 and 5 and referring next to FIG. 7, operation of the trigger assembly 210 and sear assembly 208 is described. It should be noted that in FIG. 4 the depending leg 206 and firing pin 202 are shown in the post-recoil firing position. After the firing pin 202 has reached full rearward movement during post-firing recoil, or has been fully cocked back, a firing spring (not shown) will bias the firing pin 202 and depending leg 206 forward until the depending leg 206 engages the sear 402 in its first pivotal, or "ready", position (the sear 402 being depicted in the first "ready" position in FIGS. 4, 5 and 7), at which point the firing pin 202 will cease forward movement until fired again. The sear actuator 414 is in a first actuator pivotal position in FIGS. 4, 5 and 7.

Once the firing pin depending leg 206 engages the sear 402 in the first pivotal position, the "ready" position, the firearm 100 is ready to be fired. During normal operation of the sear assembly 208 in conjunction with the trigger assembly 210, longitudinal movement of the trigger bar 212 in a rearward direction (labeled "A") in response to rearward movement of the trigger 108, as described above with respect to FIGS. 2 and 3, causes the trigger bar 212 to engage the sear actuator 414. More specifically, this rearward movement causes a generally vertical trigger bar sear contact surface 706 of the trigger bar 212 to engage the trigger bar contact surface 448 of the sear actuator 414 at a trigger bar engagement point 708, as shown in FIG. 7. As the trigger bar 212 continues to move rearward, the contact with the sear actuator 414 rotates the sear actuator 414 around the fulcrum axis 704 (denoted by direction 'B' in FIGS. 5 and 7). As the sear actuator 414 rotates in the direction B, the lower tooth 452 pushes the camming portion 422 of the sear 402 upwards, thereby causing the sear 402 to also rotate about the fulcrum axis rotational direction B. At a certain point during this rotation in the B direction, the rearward surface 418 of the rear portion 444 of the sear 402 disengages the depending leg 206 of the firing pin 202 thereby allowing the firing pin 202 to translate in a forward direction under the action of the decompressing firing pin spring for the firing pin 202 to engage a cartridge and fire the firearm 100.

Referring briefly to FIG. 2 again, during forward movement of the firing pin 202 once fired (and during corresponding rearward recoil movement) the slide 104 reciprocates and will laterally engage a bump 218 on an upper portion of the trigger bar 212. This in turn causes the trigger bar 212 to be pushed to laterally (as indicated in FIG. 5 by arrow "C") such that the trigger bar 212 is no longer contacting the sear actuator 414, allowing the sear 402 and sear actuator 414 to return to their rest positions.

Returning again to FIG. 4, this lateral sliding then allows the sear 402 to "snap" back from its second "firing" position to its first "ready" position under the force of the sear spring 404 shown in FIG. 4. As the firing pin 202 recoils rearward past the sear 402, the depending leg 206 will glance across the top surface 420 of the rear portion 444 of the sear 402, pushing the rear portion 444 down as the firing pin 202 passes rearwardly across the sear 402. Once the depending leg 206 has cleared the rear portion 444 of the sear 402, the sear 402 will once again snap back to the first "ready" position under force of the sear spring 404. At this time, a lateral portion of the trigger bar sear contact surface 706 will rest against the face of the trigger engagement leg 446 of the sear actuator 414. Finally, and completing the normal firing operation cycle, upon reaching full recoil, the firing pin 202 and depending leg 206 will once again move forward until the depending leg 206 catches the rearward surface 418 of the sear 402 and stops. At this point the trigger 108 can be moved forward again such that the trigger bar 212 moves in a forward longitudinal direction (opposite of arrow "A") and the trigger bar 212 clears the sear actuator trigger engagement leg 446 so that the trigger bar 212 can laterally "snap" back (opposite direction of arrow "C"). At that point, the trigger bar 212 is once again able to engage the sear 402 (via the sear actuator 414) to fire the firearm 100 again.

It should be noted that, as described with respect to FIG. 3 above, the optional trigger bar slot 312 in the trigger 108 allows the trigger bar 212 to fit tightly at the trigger bar pin 214 and may allow for the feel (i.e., vibration, click, or snap) of the lateral "snap" of the trigger bar sear contact surface 706 back under the sear 402 to be perpetuated to the trigger 108 and ultimately to the user. This can result in a cleaner and crisper feel to the trigger 108 allowing the user to know precisely when the firearm 100 is ready to fire again.

Returning specifically to FIG. 4, the sear spring 404 and an optional sear spring plunger 436 is preferably positioned underneath a bottom surface 438 of the rear portion 444 of the sear 402 to urge the rear portion 444 upward such that the rearward surface 418 is engagable with the depending leg 206 of the firing pin 202 (i.e., in the first "ready" position of the sear 402), though other configurations are possible. By some embodiments, the sear spring 404 resides in a sear spring bore hole 440 within the sear assembly 208 or the sear block frame 406. The sear spring bore hole 440 can comprise a variety of depths and/or widths to complement various sear spring 404 configurations. The sear spring bore hole 440 can exist in any number of orientations to achieve this functionality, too. It can exist in a predominantly perpendicular orientation to the rearward portion of the sear 402 when the sear 402 is in its first ready position, as is depicted in FIG. 3. Alternatively, the sear spring bore hole 440 may exist in a predominantly perpendicular orientation to the rearward portion of the sear 402 when the sear 402 is in its second firing position. Other orientations are possible.

The sear spring bore hole 440 width should be of adequate size to prevent inhibition of longitudinal movement (i.e., compression and decompression) of the sear spring 404 along the major axis of the sear spring 404. By one embodiment, the width of the sear spring bore hole 440 is between about 0.10 and 0.15 inches, and may be approximately 0.128 inches. Additionally, the sear spring bore hole 440 depth should be appropriately sized such that the sear spring 404 maintains at least some compression when the rear portion 444 of the sear 402 is in the upward position, thus providing continual upward force on the bottom surface 438 of the rear portion 444 of the sear 402 to continuously bias the rear portion 444 in this upward position. By one approach, the depth is between about 0.20 and 0.27 inches, and may be approximately 0.235 inches by a more specific approach. Alternatively, this continuous compression and force can be achieved by varying the length of the sear spring plunger 436. By one embodiment, the sear spring plunger 436 length is between about 0.18 and 0.20 inches. By another approach, the length is between about 0.188 and 0.192 inches, with a length being approximately 0.190 inches by yet another approach.

For a set sear spring 404, a sear spring bore hole 440 with a larger depth can provide for appropriate continual compression with the use of a longer sear spring plunger 436. The opposite is also true, in that for the same set sear spring 404, utilization of a shorter sear spring bore hole 440 depth can accommodate a shorter sear spring plunger 436. By one embodiment, the sear spring bore hole 440 depth, sear spring plunger 436 depth, and an equilibrium length of the sear spring 404 are set so that the spring is compressed by about 0.05 inches to about 0.06 inches from the equilibrium length of the sear spring 404 when the sear 402 is in the first "ready" position. By another approach, the sear spring is compressed to approximately 0.055 inches when the sear 402 is in the first "ready" position. By yet another approach, when the sear 402 is in the second "firing" position, the sear spring 404 is compressed by about 0.08 inches to about 0.10 inches from the equilibrium length of the sear spring 404. By a more specific approach, the sear spring 404 is compressed by approximately 0.09 inches when the sear 402 is in the second "firing" position.

As with any spring, the force that a spring exerts may at least be approximated using Hooke's Law, which states:

$$F_x = k(x)$$

where $F_x$ is the force exerted by the spring, k is the spring force constant of the spring, and x the longitudinal compression (or expansion) of the spring from an equilibrium point. As is discussed throughout this disclosure, the force exerted by the sear spring 404 on the sear 402 is one factor that has great effect on the trigger pull weight of firearm 100 as well as sear flutter phenomena. Thus, as identified above, for a set sear spring 404, to achieve the proper force on the sear 402 throughout its rotation or movement, the depth of the sear spring bore hole 440 and/or the sear spring plunger 436 should be carefully selected.

As is commonly understood in the art, a preferred method of specifying a spring having a specific force for use in a firearm 100 is by specifying a spring weight of that spring. Spring weight of a sear spring 404 refers to the maximum force the sear spring 404 will exert at the extreme of its normal operation in the applied system, i.e., at the point where the spring will have the most compression (or expansion/tension) during normal operation. For example, the spring weight of the sear spring 404 would be the longitudinal force exerted by the sear spring 404 when the sear 402 is in the second "firing" orientation (i.e., when the rear portion 444 is down), at which point the sear spring 404 experiences the highest compression in its normal operation in the sear assembly 208.

A convenient way to measure the spring weight of a specific sear spring 404 is to determine the precise length of the sear spring 404 at the moment when the sear 402 releases the firing pin 202 (i.e., at the second "firing" position). This determined length will be substantially the same for each and every sear spring 404 used of various reasonable spring weights. Then, using well understood techniques and devices, the specific sear spring 404 can be compressed to that precise length and the longitudinal force exerted by the spring measured. This measured force will be the spring weight of that specific sear spring 404. Different springs having different spring constants and/or equilibrium lengths will result in different spring weights in the firearm system. For example, two springs may have the same spring constant but have different equilibrium lengths such that when the longer spring is compressed to the determined length (above), it will have a higher spring weight than the shorter spring.

Armed with a basic understanding of the general overall operation and construction of the firing mechanism 200 and trigger assembly 210 in accordance with various embodiments, the reader is now able to understand further details of this disclosure.

Figure 6:
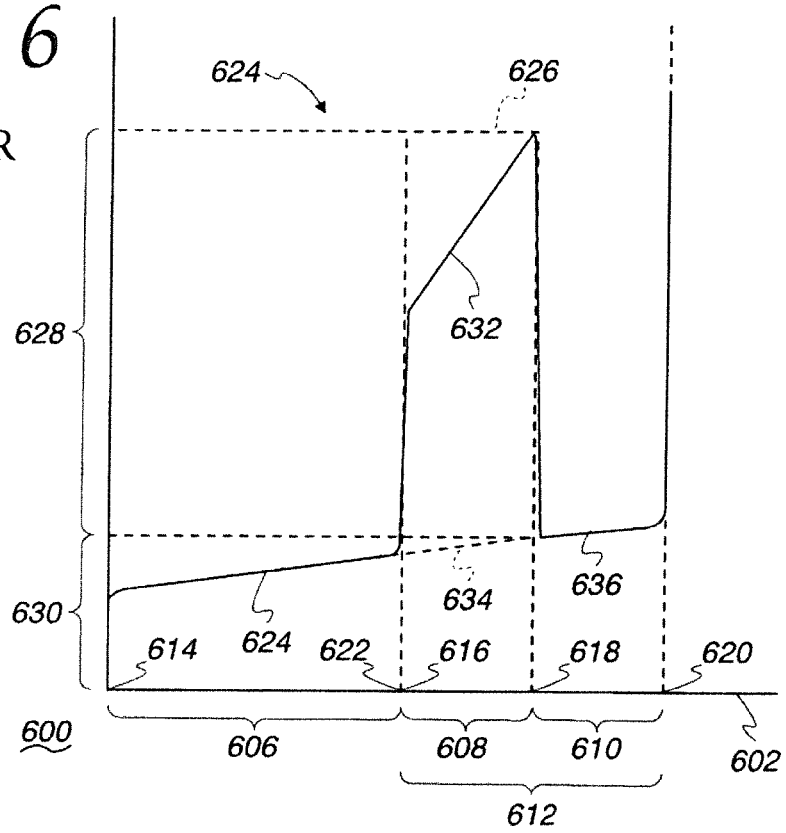
Fig. 6 PRIOR ART
FIG. 6 is a graph illustration various aspects of the firing mechanism in accordance with various embodiments.

Referring now to FIG. 6, a graph 600 illustrating trigger pull weight across different travel segments is shown. The graph is simplified and exaggerated to distinctly show various segments and properties. The horizontal axis 602 represents the rearward travel of the trigger 108 through its operation. The vertical axis 604 represents trigger pull weight. As was discussed in the background section above, the overall travel of a trigger 108 during operation is divided into different travel segments, as are indicated. These segments include a pre-travel travel segment 606, an engagement travel segment 608, an over-travel travel segment 610, and a reset travel segment 612. The pre-travel travel segment 606, also called "take up," is the distance the trigger 108 moves from its forward-most resting position 614 (the steady-state position which the trigger 108 exists in the absence of an applied rearward force) to an engagement point 616 where the trigger bar 212 first engages the sear 402 via the sear actuator 414. (It should be noted that engagement occurs at the point where the trigger bar 212 (via the sear actuator 414) begins to influence rotational movement of the sear 402. The engagement travel segment 608 is the distance the trigger 108 moves from the engagement point 616 until the break point 618, where the sear 402 releases the firing pin 202. It is during this engagement travel segment 608 where the sear 402 experiences rotational movement influenced by the trigger bar 212. The over-travel travel segment 610 is the over-travel distance the trigger 108 travels from the break point 618 to a stop point 620 where the trigger 108 cannot move any further in a rearward direction, typically due to one or more mechanical stops (e.g. a rearward stop shoulder 1108 of the trigger 108). The reset travel segment 612 is the post-firing forward travel distance during which the trigger 108 returns from the stop point 620 to the reset point 622 where the trigger bar 212 snaps back under the sear 402 and sear actuator 414 (as described above), at which point the firearm 100 can be fired again. By most embodiments, and as is indicated in FIG. 6, this reset point 622 is approximately the same physical point as the engagement point 616, thus making the reset travel segment 612 approximately equal and opposite to the sum of the engagement travel segment 608 and over-travel segment 610. Lastly, though not described in detail here, the trigger 108 can return from the reset point 622 or engagement point 616 back to the resting position 614, which distance is simply approximately equal and opposite the pre-travel travel segment 606.

The various travel distances may be measured at a single point on the trigger 108, typically at some point central to the trigger 108. Measurements taken and described herein are taken from a point existing between about 1.1 inches and about 1.3 inches from the center of the trigger pin 216 about which the trigger 108 rotates. Additionally, the measurements were measured in the longitudinal direction running forward and backward with respect to and parallel to the longitudinal firing axis 110 (as opposed to an arc or angular measurement of the movement of the trigger 108 about the trigger pin 216). For purposes of this application, trigger travel distances are measured as described above, in the direction parallel to the longitudinal firing axis 110 at a point on the trigger 108 approximately 1.17 inches from the center of the trigger pin 216. All force measurements were taken simultaneously at that same point.

During the various trigger travel segments, the trigger 108 will produce varying pull weights. The variation in the trigger pull weights allows a user to feel the precise location of the trigger 108 throughout its travel during normal operation. Trigger pull weight generally is the longitudinally rearward force applied to the trigger 108. The trigger pull weight of a point in the travel of the trigger 108 is the force required to maintain the trigger 108 at that point. It can also be described as the minimum longitudinally rearward force required to move the trigger 108 to a specific point (i.e., to the engagement point 616). Excluding various unaccounted-for nominal frictional force effects (such as static or sliding friction), any applied rearward force of greater value than the trigger pull weight at a specific point will allow for further rearward movement of the trigger 108 past that specific point.

The trigger pull weight profile 624 depicted in FIG. 6 is at least representative of a typical pull weight profile of a firearm 100, though not necessarily to scale nor as detailed (i.e., absent slight variations through the travel). Through the pre-travel travel segment 606, the trigger 108 may have a pre-travel trigger pull weight, represented by a corresponding portion of the trigger pull weight profile 624. Though other factors may contribute to the value of this force, the primary source of the force through this pre-travel travel segment 606 is tension from the expanding or stretching trigger return spring 302. This force is illustrated as an approximately linearly increasing line over distance as the trigger 108 return spring stretches further and exerts increasing force, which is, of course, in accordance with Hooke's Law as previously described. The slope of the increasing force may be either steeper or more gradual (even nominal) depending on the spring constant of the trigger return spring 302. A user may or may not sense the increasing force as they move the trigger 108 through the pre-travel travel segment 606, though a user most likely will sense at least some force.

As is illustrated in FIG. 6, and as is typical with firearms 100, though not absolute, the trigger pull weight increases at the engagement point 616. This is due to the relatively higher force required to move the trigger bar 212 rearward while engaging and rotating the sear 402, where such rotation is opposed by the sear spring 404. This relatively large increase may be advantageous as the user can move the trigger 108 past the pre-travel travel segment 606 to the engagement point 616 without entering the engagement travel segment 608 by applying only enough force to travel through the pre-travel segment 606, but less than is required to begin to rotate the sear 402 and sear actuator 414. This then allows the user to operate the firearm 100 safely in that the pre-travel travel segment 606, or "take up," allows for a physical travel buffer to prevent short unintentional movements of the trigger 108 that might otherwise result in an accidental firing had the pre-travel travel segment 606 not existed (e.g., when drawing the firearm 100 or when moving with the firearm 100 in hand). When the user is in a situation or position where they are preparing to fire the firearm 100, the user can then pull the trigger 108 to the engagement point 616 and hold it there until the moment when they actually intend to fire. While holding the trigger 108 at the engagement point, the user can aim the firearm 100 and then can continue movement of the trigger 108 from the engagement point 616 past the break point 618 to fire. As the distance from the engagement point 616 to the break point 618 is less than the distance from the resting position 614 to the break point 618, the movement of the user's firing finger is reduced between aiming and firing, which results in less overall movement of the hand between aiming and firing, thereby producing greater accuracy.

To fire the firearm 100, the user must apply a force exceeding the maximum trigger pull weight 626 of the firearm 100, typically (though not always) existing proximate and prior to the break point 618, thereby allowing the trigger 108 to travel past the break point 618 to fire the firearm 100. It should be noted however, that maximum trigger pull weight 626 may exist at any point in the engagement travel segment 608. As mentioned above, the increased trigger pull weight during the engagement travel segment 608 as compared to the pre-travel travel segment 606 is due to the relatively higher force required to move the trigger bar 212 rearward while engaging and rotating the sear 402 and sear actuator 414 (in direction "B"). The sear spring 404 exerts a force in opposition to the rotation, which translates to the increase in trigger pull weight during the engagement travel segment 608.

In addition to the force exerted by the sear spring 404, a force is exerted by the interaction between the rearward surface 418 of the sear 402 and the depending leg 206 of the firing pin 202. Referring briefly to FIGS. 4, 5, and 7, as the sear 402 is rotated in the B direction (under influence of the trigger bar 212 during firing), the rotational movement of the rearward surface 418 in an arc centered around the fulcrum axis 704 will push the depending leg 206 and firing pin 202 longitudinally rearward (i.e., will cause cocking of the firing pin 202). As the firing pin 202 is biased forward by the firing spring, this results in additional forces exerted on the sear 402 that oppose the rotation of the sear 402 in the B direction, which results in a higher maximum trigger pull weight 626.

Referring specifically to FIG. 7, one factor affecting the force exerted by the depending leg 206 on the sear 402 during firing, and thus affecting maximum trigger pull weight 626 is an angle 712 of the rearward surface 418 of the rear portion 444 of the sear 402 as compared to the sear longitudinal axis 710. The rearward surface 418 comprises, at least partially, a substantially flat surface for engagement by the depending leg 206 of the firing pin 202. The sear 402 in the present embodiment also includes a rounded surface to produce a point contact with the depending leg 206, whereby a "clean" or "crisp" trigger feel is enhanced. If the angle 712 is any angle greater than a tangential angle of the arc of the movement of the rearward surface 418 about the fulcrum axis 704 (i.e., about 75 to 85 degrees, as the sear 402 rotates in the "B" direction (see FIGS. 4 and 5), the rotational movement of the rearward surface 418 will cause the firing pin 202 to also move longitudinally rearward (i.e., will cause cocking of the firing pin 202). This rearward movement, which is opposed by the firing spring, results in additional force that oppose the rotation of the sear 402 in the "B" direction, which results in a higher maximum trigger pull weight 626. It should be noted, however, that the force opposing the rotation of the sear 402 exerted by the depending leg 206 is, for the most part, independent of the spring weight of the sear spring 404 or even the existence of the sear spring 404.

In practice, to ensure that the s 418 properly "catches" the depending leg 206 after firing, it may be advantageous to set this angle 712 greater than the above described tangential arc angle. If not, there is an increased likelihood that the rearward surface 418 will fail to "catch" the depending leg 206 as it travels forward during recoil, resulting in a dead trigger, a double fire, or a misfire. Optionally by one embodiment, the angle 712 of the rearward surface 418 can be very close to 110 degrees. By another embodiment, the angle 712 exists in a range of about 100 degrees to about 114 degrees. By yet another approach, the angle 712 is between about 110 and about 112 degrees, and is approximately 111 degrees by more specific approaches. These ranges establish a balance between maintaining safety (i.e., ensuring a proper "catch" post-firing) and reducing the force exerted by the depending leg 206 during firing (i.e., reducing maximum trigger pull weight 626).

Returning now to FIG. 6, because the trigger return spring 302 continues to exert a force during the engagement travel segment 608, the trigger pull weight during this segment is the summation of the force exerted by the trigger return spring 302 and the engagement/rotation of the sear 402. Thus, the maximum trigger pull weight 626 or (net trigger pull weight) can be separated into at least two portions: 1) a trigger pull weight attributable to the sear 628 and 2) a trigger pull weight attributable to the trigger return spring 630.

Typically, the force exerted by the trigger return spring 302 will increase in an approximate linear manner over the trigger travel distance of horizontal axis 602. Additionally, although shown as linearly increasing over distance, the trigger pull weight line 632 during the engagement travel segment 608 could be a curve trending upward, leveling off, or having numerous changes across the engagement travel segment 608. Additionally, the maximum trigger pull weight 626 may be achieved prior to the break point 618. A user may or may not sense the changes in force as they move the trigger 108 through the engagement travel segment 608 to the break point 618.

After the trigger 108 passes the break point 618, the trigger 108 enters the over-travel travel segment 610 as the trigger bar 212 no longer engages the sear 402 (via the sear actuator 414), and thus no longer has forces exerted upon it by the sear actuator 414. Thus, as with the pre-travel travel segment 606, absent any other interferences, the primary source of trigger pull weight during over-travel may be the trigger return spring 302. Again, because the trigger return spring 302 is likely to be linear across the over-travel travel segment 610, the spring 302 will continue to exert its linearly increasing force on the trigger 108, as is indicated by line segment 636 of the trigger pull weight profile 624. When the trigger 108 reaches the stop point 620, further rearward movement is inhibited, as is depicted by the sharp increase in force extending well beyond the scope of the graph in FIG. 6. (Theoretically, this stop force would be infinite. However, at a very high force, beyond that which most human fingers are capable of, the trigger 108, rearward stop shoulder 1108, or other mechanism will eventually experience failure.)

After reaching the stop point 620, the trigger 108 can be moved in a forward direction through the trigger reset travel segment 612 starting at the stop point 620 and ending at the trigger reset point 622. Forward movement is achieved by application of a force that is less than the trigger pull weight at that point in the trigger travel. The forward movement is caused entirely or nearly entirely by the force exerted by the trigger return spring 302 that biases the trigger 108 toward the forward direction. As the trigger 108 moves forward, it will pass the break point 618. However, the trigger pull weight force will most likely maintain its current force line, as depicted by dashed line segment 634. This is because, as discussed above, a lateral portion of the sear contact surface 706 will rest against contact surface 448 of the sear actuator 414. Even if while traveling between the break point 618 and the reset point 622, and prior to reaching the reset point 622, the user moved the trigger 108 again in the rearward direction, the force would most likely continue on the dashed line segment 634 as the trigger bar 212 has not yet been enabled to engage the trigger bar contact surface 448 of the sear actuator 414 (and the firearm 100 would not fire). To complete travel through the reset travel segment 612, the trigger 108 will travel past (i.e., forward of) the reset point 622, at which time the trigger bar sear engagement portion 428 will "snap" back in front of the trigger engagement leg 446 of the sear actuator 414, thus enabling the firearm 100 to be fired again. So configured, rearward trigger travel starting only from a point forward of the reset point 622 can result in firing the firearm 100.

Lastly, if the user removes all force from the trigger 108 (or applies so little force as to be less than the trigger pull weight at the resting position 614), the trigger 108 will return to the resting position 614.

The most influential factor on maximum trigger pull weight 626 is the force exerted by the sear 402. Maximum trigger pull weight 626 will increase when using a sear spring 404 having a higher spring weight (i.e., a higher force at its most compressed position in normal operation in conjunction with the sear 402, typically being at the break point 618 when the sear 402 achieves the most rotation), and vice versa. Although it is often viewed as advantageous to have a lowered maximum trigger pull weight (which requires less force from a user to pull the trigger and thus increases accuracy), lowering the spring weight of the sear spring 404 may exasperate already existing issues with firearms 100, particularly "sear flutter."

After firing and during recoil, the firing pin 202 depending leg 206 glances rearward across the top of the sear 402 causing the sear 402 to briefly rotate to allow passage of the firing pin 202. Sear flutter occurs when the sear 402 continues to vibrate or flutter after rearward passage of the firing pin 202 during recoil. As the firing pin 202 again moves forward, the sear 402 may still be in a vibrational state where it is rotated back toward the firing position (i.e., the rear portion 444 of the sear 402 is down instead of up) preventing the rearward surface 418 of the sear 402 from catching the firing pin 202 depending leg 206, and allowing the firing pin 202 to continue forward travel past the sear 402. This results in a non-fireable firearm 100 ("dead trigger") until the firearm 100 is manually cocked once again.

Increasing the spring weight of the sear spring 404 provides greater biasing force to resist against sear flutter, thus greatly decreasing the likelihood of a "dead trigger" due to sear flutter. However, increasing the spring weight of the sear spring 404 results in higher maximum trigger pull weight 626, which is in direct competition with the often desired lower maximum trigger pull weight 626. Users of firearms 100 have traditionally been forced to choose between increased reliability (lower sear flutter likelihood) with a higher maximum trigger pull weight 626, or lower maximum trigger pull weight 626 with decreased reliability (increased sear flutter likelihood). Described herein is a new sear 402 design that provides both desirable benefits: increased reliability with decreased or maintained maximum trigger pull weight.

Referring again to FIG. 7, a side elevation of the sear actuator assembly 408 and the trigger bar 212 in accordance with various embodiments is provided. As described before, the sear 402 has a bottom surface 438 for engagement by the sear spring 404 and/or sear spring plunger 436 to bias the rear portion 444 of the sear 402 in an upward direction (opposite direction "B" in FIGS. 4 and 5). The trigger bar engagement point 708 is the point at which the trigger bar contact surface 448 of the sear actuator 414 engages the sear contact surface 706 of the trigger bar 212. The trigger bar engagement point 708 exists at a measurable engagement radius 702 from the center of the fulcrum axis 704 (measured as a radius 702 because the sear actuator 414 rotates about the fulcrum axis 704). While in individual firearms the actual trigger bar engagement point 708 location may vary vertically across the trigger bar contact surface 448, for consistency of comparison the trigger bar engagement point 708 is located at a radially distal edge of the trigger bar contact surface 448, i.e. where the trigger bar contact surface 448 intersects the outer face 460. By one approach, when installed in the firearm 100 and when the sear is in the first ready position, the radius 702 typically will be measured at an angle between about 63 and 68 degrees from the longitudinal firing axis 110 of the firearm 100. Additionally, the length of the radius 702 may or may not change during the engagement travel segment 608 as the trigger bar 212 engages the sear actuator 414 and the sear actuator 414 rotates during the engagement travel segment 608. By one approach, the radius 702 is measured at the trigger bar engagement point 708 when the trigger bar 212 first engages the trigger bar contact surface 448, and is how specific radius 702 measurements described herein are measured. By another approach, the radius 702 is measured at the trigger bar engagement point 708 when the sear has rotated to the break point 618. In the present embodiment, the engagement radius 702 is approximately 0.24 inches.

The sear actuator 414 is disclosed as having an increased engagement radius 702 as compared to a sear actuator with a shorter trigger engagement leg length 464, e.g. a sear actuator 414 where the trigger engagement leg 446 does not extend forward past the actuator extension 458. The increased engagement radius 702 acts as a longer lever arm with increased mechanical advantage for the trigger bar 212 to engage and rotate the sear actuator 414, thereby rotating the sear 402. Accordingly, with the longer trigger engagement leg length 464, an increase in the sear spring 404 weight has less of an effect on maximum trigger pull weight 626 than did with previous actuator 414 designs having a shorter trigger engagement leg length 464. Thus, using the sear actuator 414 allows for a lower maximum trigger pull weight 626 without the need to alter the sear spring 404, or allows for the same maximum trigger pull weight 626 (as with previous non-forward set sear designs) while using a sear spring 404 having a higher spring weight.

For example, current production sear actuators 414 on at least one mass-production firearm 100 typically have a radius 702 length of between about 0.19 and 0.20 inches and utilize a sear spring 404 having a spring weight of between about 0.5 and 0.7 pounds. This combination achieves a maximum trigger pull weight 626 between about 5.25 and 5.75 pounds. However, when utilizing the above described sear actuator 414 having an increased radius 702 length of at least, by one example, 0.23 inches in conjunction with the sear as described herein, with the same above described factory-specified sear spring 404 and trigger return spring 302, a maximum trigger pull weight 626 of between about 3.75 and 4.25 pounds may be produced. By another example, the increased radius 702 length is at least 0.23 inches with similar or better reduction in maximum trigger pull weight 626.

Alternatively, when using the sear actuator 414, the same or similar maximum trigger pull weight 626 as a current production sear actuator 414 can be achieved by increasing the spring weight of the sear spring 404 from the previous 0.5-0.7 pound spring weight to between about 1.3 to 1.8 pounds. Accommodating an increase in spring weight of the sear spring 404 provides the benefit of drastically decreases the likelihood of sear flutter phenomena during use, thus increasing reliability without increasing maximum trigger pull weight 626. Previous attempts to cure the sear flutter phenomena included simply increasing the spring weight of the sear spring 404, which resulted in drastic increases in maximum trigger pull weight 626 with previous sear actuator designs. With the sear actuator 414, a sear spring 404 having a higher spring weight can be utilized without affecting the maximum trigger pull weight 626 as drastically.

Figure 8:
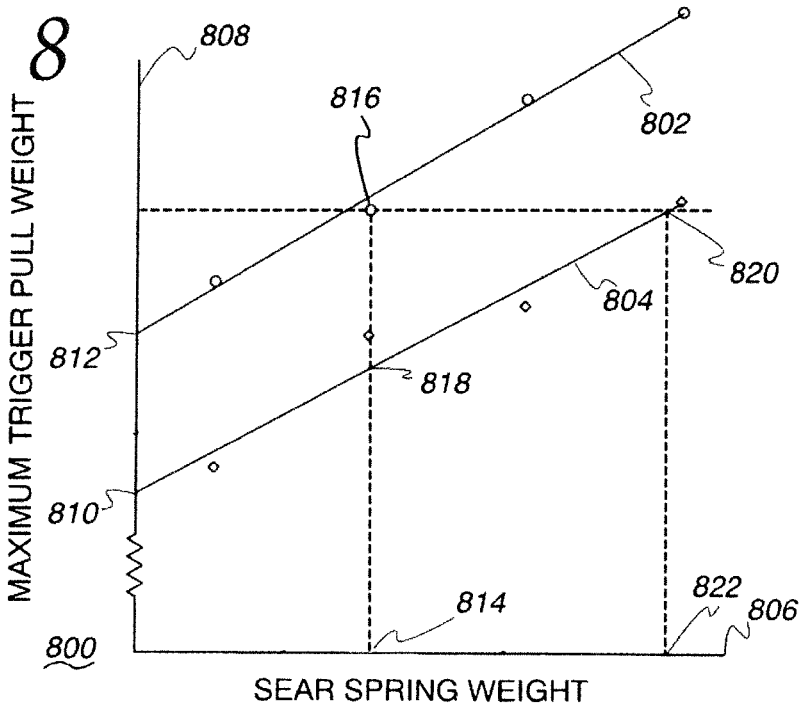
FIG. 8 is graph of characteristics of the firing mechanism of FIG. 2 in accordance with various embodiments.

This is further illustrated in FIG. 8, which displays a graph 800 comparing performance of a previous sear actuator assembly design (steeper line 802) with the current sear actuator assembly 408 design (flatter line 804). The horizontal axis 806 is the spring weight of the sear spring 404, and the vertical axis 808 is maximum trigger pull weight (which may correspond to maximum trigger pull weight 626 in FIG. 6). Accordingly, each line 802, 804 is a plot of how maximum trigger pull weight (attributable to the sear) changes with various sear spring 404 weights with a previous sear actuator assembly design and the new sear actuator assembly 408.

Each line 802, 804 can be determined and plotted by installing a sear spring 404 with a known spring weight (the process to measure the sear spring 404 weight being described above) and measuring the maximum trigger pull required to fire the firearm. By one form of testing, it can be assumed that the trigger return spring 302 will always produce approximately the same force at the point of maximum trigger pull weight no matter what sear spring 404 weight is utilized. As such, the test can be performed without a trigger return spring 302 installed to simply gather data with respect only to a maximum trigger pull weight attributable to the sear 628 and to ignore a maximum trigger pull weight attributable to the trigger return spring 630 (wherein the aggregation of these two maximum trigger weight portions 628, 630 is the net maximum trigger pull weight of the trigger pull weight profile 624). Accordingly, in this alternative form of testing, vertical axis 808 in FIG. 8 may represent maximum trigger pull weight attributable to the sear (corresponding to 628 in FIG. 6) as adding the maximum trigger pull weight attributable to the trigger return spring 630 value will simply serve to uniformly shift the values up by that value 630. The respective slopes of the lines 802 and 804 should remain approximately the same according to either testing method.

Once enough data points (sear spring 404 weight and corresponding maximum trigger pull weight attributable to the sear 628) have been collected, a linear regression can be calculated (using techniques as are commonly understood) to discover the equation for a line 802, 804 representing the average of the data points, the equation having a slope and a y-intercept 810 or 812. By at least one embodiment, such an equation for a line 804 when using the new forward set sear 40*s* and sear actuator 414 will have a slope between about 0.6 and about 1.0. By another embodiment, the equation for this line 804 will have a slope between about 0.7 and about 0.9, and by yet another embodiment, the equation for this line 804 will have a slope of approximately 0.8. As a comparison, the equation for the line 802 when using a previously available sear actuator assembly design will have most typical slopes between about 0.7 and 1.1. By this comparison, it is apparent that the increased mechanical advantage offered by the new sear actuator assembly 408 allows for a less drastic effect on maximum trigger pull weight when altering the sear spring 404 weight.

With respect to FIG. 8, four specific data points were collected and plotted using the new forward set sear 402 and sear actuator 414 (symbolized as diamond plot points surrounding line 804) and are shown in the Table 1 below.

TABLE 1

| Sear Spring Weight (pounds) | Maximum Trigger Pull Weight Attributable to the Sear (pounds) |
|---|---|
| 0.295 | 1.276 |
| 0.675 | 1.835 |
| 1.005 | 1.957 |
| 1.585 | 2.402 |

Upon entering these data points into a program (such as Microsoft® Excel®) to generate a linear regression, an equation for a line was produced having a slope of 0.83 and a y-intercept 810 of 1.13. The same procedure was performed for the line 802 for the previously available sear 402 and sear actuator 414 and included various data points represented by circular dots surrounding line 802. The same linear regression calculation was performed resulting in a slope of 0.91 and a y-intercept 812 of 2.23.

The y-intercepts 810, 812 represent the maximum trigger pull weight attributable to the sear 628 in the absence of the sear spring 404 (i.e., zero spring weight), which primarily comprises the force exerted on the rearward surface 418 of the sear 402 by the depending leg 206 (as was previously described). Each different sear 402 may or may not produce a different y-intercept value as shown in FIG. 8, which is indicative of different forces required to rotate the sear 402 due to the forces exerted on the rearward surface 418 (as a result of, for example, different angles 712 of the rearward surface 418 and different radius 702 lengths). For the new forward set sear 402 configured as described, this force (i.e., the y-intercept) can typically be between about 0.8 and 1.4 pounds by one approach, or can be between about 0.9 and 1.3 by another approach, or can be between about 1.0 and 1.2 by a third approach. This force should remain constant for each different sear actuator 414 independent of the spring weight of the sear spring 404 used. Thus, the calculated slope primarily captures the approximately linear relationship between the maximum trigger pull weight attributable to the sear 402/sear actuator 414 and the sear spring 404 weight, and the approximately linear relationship is a function of the line 804 having the described slope.

Using the example values from table 1, a sear spring 404 having a spring weight of 0.675 pounds, as may be represented by point 814 along the horizontal axis 806, may produce a maximum trigger pull weight attributable to the sear 628 of approximately 2.785 pounds shown at point 816 along line 802 (i.e., when using a previous sear actuator assembly design). However, this same value of spring weight at point 814 may produce a lower maximum trigger pull weight attributable to the sear 628 of approximately 1.69 pounds shown at point 818 along line 804 (i.e., when using the new sear actuator assembly 408). Alternatively, to achieve the same or similar maximum trigger pull weight at point 816 with the new sear actuator assembly 408 as with the previous sear actuator assembly design (shown as point 820 on line 804), a sear spring 404 with a higher spring weight between about 1.9 and 2.1 pounds would be required (approximated as point 822 on the horizontal axis 806). Using this increased sear spring weight at point 820 advantageously reduces the likelihood of sear flutter.

Figure 9:
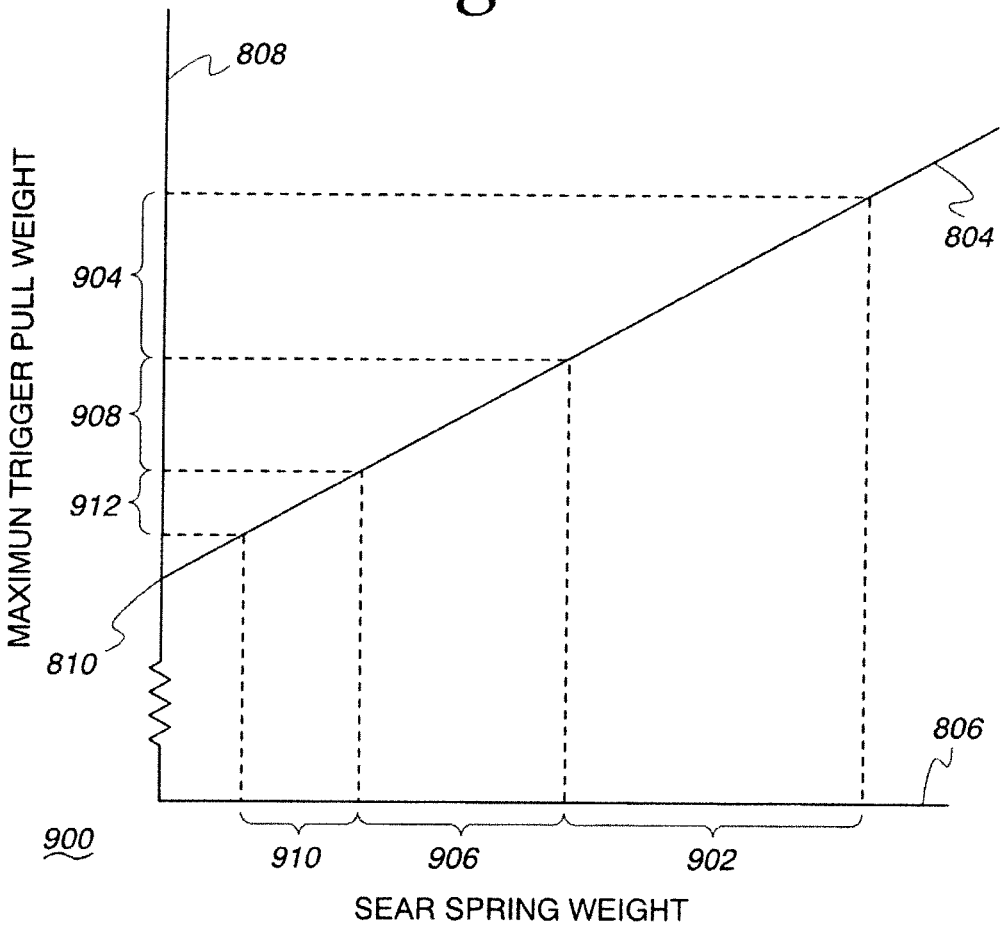
FIG. 9 is graph of characteristics of the firing mechanism of FIG. 2 in accordance with various embodiments.

Referring now to FIG. 9, another graph 900 illustrating ranges of operation in accordance with at least one embodiment is shown. Just as in the graph 800 of FIG. 8, the horizontal axis 806 represents the spring weight of the sear spring 404, and the vertical axis 808 represents the resulting maximum trigger pull weight (attributable to the sear 402). Line 804 again represents maximum trigger pull weight attributable to the sear 402) of the new forward set sear 402. Various ranges of sear spring 404 weights are shown with corresponding ranges of maximum trigger pull weights. (Though only three ranges are illustrated, any number of ranges may exist.) Some example ranges are given: Range 902 may represent a sear spring weight between about 0.9 and 1.7 pounds, which may correspond to a range of maximum trigger pull weight attributable to sear between about 1.9 and 2.4 pounds as indicated by range 904. Range 906 may represent a sear spring weight between about 0.3 and 0.95 pounds, which may correspond to a range of maximum trigger pull weight attributable to sear between about 1.4 and 1.9 pounds as indicated by range 908. Range 910 may represent a sear spring weight between about 0.05 and 0.35 pounds, which may correspond to a range of maximum trigger pull weight attributable to sear between about 1.2 and 1.4 pounds as indicated by range 912.

It should be noted that the increased radius 702 length of the sear actuator 414 changes not only the feel of the trigger 108, but also affects the timing of the firearm 100. First, due to this forward set nature, the trigger bar 212 will reach the sear engagement point 616 and the break point 618 earlier in its rearward travel as compared with previous sear actuator assembly designs. This has the effect of reducing the pre-travel travel segment 606 distance, even in the absence of any other changes. For example, in a firearm 100 with a previous sear actuator assembly design, a travel distance from the resting position 614 to the break point 618 may be between about 0.42 and 0.46 inches. However, due to the geometry of the sear actuator 414, this same distance may be between about 0.29 and 0.33 inches without any other alterations to the firearm 100 (which includes the use of the standard manufactured trigger 108). In one embodiment the sear actuator 414 is configured to produce the trigger pre-travel distance is no greater than approximately 0.22 inches.

Figure 10:
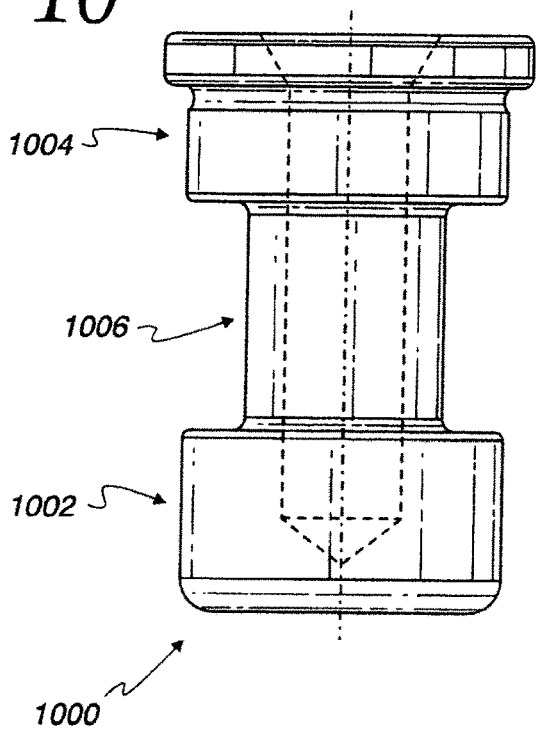
FIG. 10 is a striker block as maybe used with the firing mechanism of FIG. 2 in accordance with various embodiments.

To understand the second timing change, we refer next to FIG. 10, which shows a striker block 1000 in accordance with various embodiments. The striker block 1000 operates as an additional safety device to block unintentional forward progression of the firing pin 202. The striker block 1000 is primarily a cylinder, though other configurations may be suitable, and has a lower portion 1002 and an upper portion 1004 with a narrower mid portion 1006. Referring again briefly to FIG. 2, the striker block 1000 (not shown in FIG. 2) resides vertically above an upper rearward sloping surface disposed on the trigger bar 212, a striker block contact surface 220, and is biased downward by a striker block spring (not shown). This striker block contact surface 220, also shown in FIG. 7, operates to move the striker block 1000 upward as the trigger bar 212 moves longitudinally rearward such that the upper portion 1004 does not block the path of the firing pin 202. Particularly, a protrusion 222 on the side of the firing pin 202 will pass through the narrower mid portion 1006 to enable firing. Thus, in order to fire, the trigger bar 212 must be moved rearward a minimum distance to lift the striker block 1000 from the path of the firing pin 202. This minimum distance then affects the maximum radius 702 which the sear actuator 414 can accommodate. If the radius 702 length is extended too far, the sear 402 may release the firing pin 202 before the striker block 1000 is cleared from the path of the firing pin 202. Although this backwards functionality may not in and of itself be a safety hazard or otherwise affect the actual firing of the firearm 100, it can affect the feel of the trigger 108 as the trigger 108 will reach the sear break point 618 prior to releasing the firing pin 202 (by continuing trigger travel to move the striker block 1000), rather than concurrently. Thus, the sear actuator 414 is designed to maximize the radius 702 but still avoid the sear 402 releasing the firing pin 202 prior to the protrusion 222 of the firing pin 202 being able to clear the striker block 1000.

Also, by at least some embodiments, engagement surfaces, such as those on the sear 402 (rearward surface 418, top surface 420, and camming surface 426), trigger bar 212 (trigger bar sear engagement surface 434, striker block contact surface 220), depending leg 206, striker block 1000, and trigger bar contact surface 448 may be polished so as to greatly reduce sliding frictional forces that add additional parasitic components to maximum trigger pull weight 626.

Figure 11:
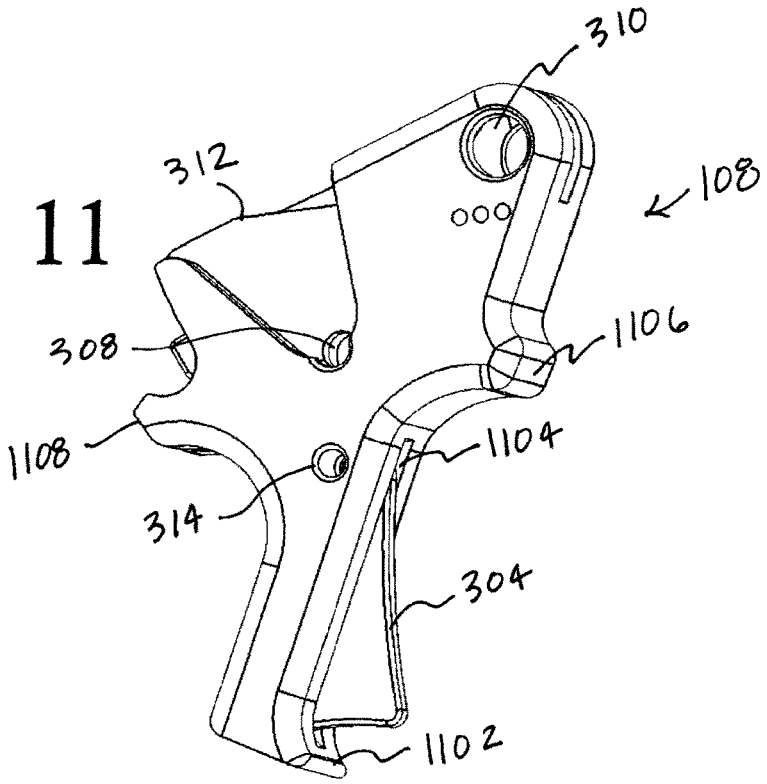
PRIOR ART Fig. 11
FIG. 11 is an illustration of a trigger as may be used in the firing mechanism of FIG. 2 in accordance with various embodiments.

Referring next to FIG. 11, a new trigger 108 in accordance with various embodiments is shown. The trigger 108 comprises a front face 1102, the trigger pin opening 310, the trigger bar pin opening 308, the trigger bar slot 312, a central safety blade slot 1104, the trigger safety blade 304, the trigger safety blade pin 306, the trigger safety blade pin opening 314, a forward stop shoulder 1106, and a rearward stop shoulder 1108. By at least one embodiment, the trigger 108 is composed of a substantially inflexible material, such as aluminum, steel, or other inflexible materials as are known in the art.

The trigger 108 is configured to connect to the frame 102 of the firearm 100 by the trigger pin 216 inserted through the trigger pin opening 310 near the top of the trigger 108 and corresponding openings in the frame 102 so that the trigger 108 is pivotally mounted to the frame 102. As was described in conjunction with FIGS. 2 and 3, the trigger 108 is further configured to connect to the trigger bar 212 via the trigger bar pin 214 inserted through the trigger bar pin opening 308. The trigger bar pin opening 308 may be located between the trigger pin opening 310 and the vertical center of the trigger 108 by one approach. The trigger bar slot 312 disposed on the rear of the trigger 108 ensures a tight fit between the trigger bar 212 and the trigger 108, limiting lateral play of the trigger bar 212. The trigger 108 may further comprise the trigger safety blade 304 pivotally connected to the trigger 108 by the trigger safety blade pin 306 through the trigger safety blade pin opening 314.

The trigger safety blade 304 is vertically interposed between two interior surfaces of the safety blade slot 1104, which comprises a vertical slot in the front face 1102 of the trigger 108 located approximately laterally central to the front face 1102. The trigger safety blade 304 operates to impede rearward movement of the trigger 108 when the trigger safety blade 304 is not depressed rearward at least partially into the safety blade slot 1104 of the trigger 108. When the trigger safety blade 304 is depressed, the trigger safety blade 304 rotates around the trigger safety blade pin 306 to disengage at least one safety mechanism. The lower portion of the trigger safety blade 304 is pivotally biased in a forward direction by a trigger safety blade biasing spring or other biasing means such that at least a portion of the trigger safety blade 304 extends forward beyond the front face 1102 of the trigger 108. Optionally, the trigger safety blade 304 comprises a tooth or pick of sorts at its top end that terminates between two or more coils of the trigger return spring 302 (see FIG. 3). By this, the trigger safety blade 304 is biased in the forward direction as any movement away from the forward position causes the trigger return spring 302 to exert an opposite force on the trigger safety blade 304. Like the trigger 108, by at least one embodiment, the trigger safety blade 304 may also be comprised of a substantially inflexible material, such as aluminum, steel, or other inflexible materials.

By at least one embodiment, the front face 1102 includes a straight portion interposed between two curved portions, with the straight portion generally coinciding with the safety blade slot 1104. The straight portion allows a trigger finger to be placed farther from the trigger pin 216, increasing leverage. The front face 1102 is substantially flat laterally across the face 1102. The substantially flat lateral face 1102 provides a benefit in that it helps guide a user's finger solely in a rearward motion, which helps improve accuracy. An additional safety benefit is that a user is less likely to unintentionally depress the trigger safety blade 304 unless force is applied directly rearward in the center of the front face 1102, as the outer edges of the front face 1102 interfere with indirect finger movement to depress the trigger safety blade 304. It is noted, however, that this disclosure is fully compatible with triggers 108 having a laterally curved or rounded front face 1102 as well.

The forward stop shoulder 1106, located above the front face 1102, forms a generally forward-facing hump in the trigger front profile and is configured to stop forward movement of the trigger 108 when the forward stop shoulder 1106 contacts a frontward portion of the frame 102. The rearward stop shoulder 1108 forms a generally rearward-facing hump in the trigger rear profile and is configured to stop rearward movement of the trigger 108 when the rearward stop shoulder 1108 contacts a rearward portion of the frame 102. The operation of the forward stop shoulder 1106 and the rearward stop shoulder 1108 are described further below in FIGS. 12-14.

Figure 12:
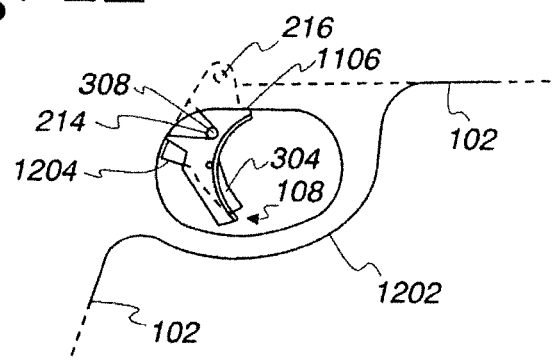
Fig. 12 PRIOR ART
FIG. 12 illustrates the trigger of FIG. 11 as may be installed in the firearm of FIG. 1 in accordance with various embodiments.
Figure 13:
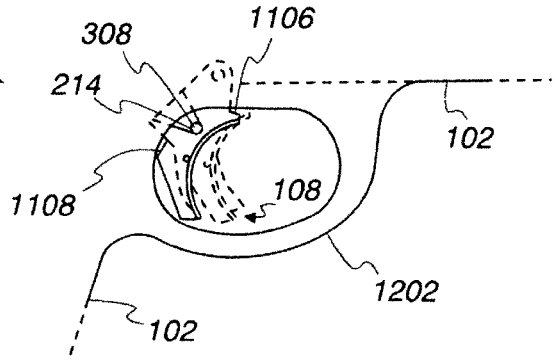
Fig. 13 PRIOR ART
FIG. 13 further illustrates the trigger of FIG. 11 as may be installed in the firearm of FIG. 1 in accordance with various embodiments.
Figure 14:
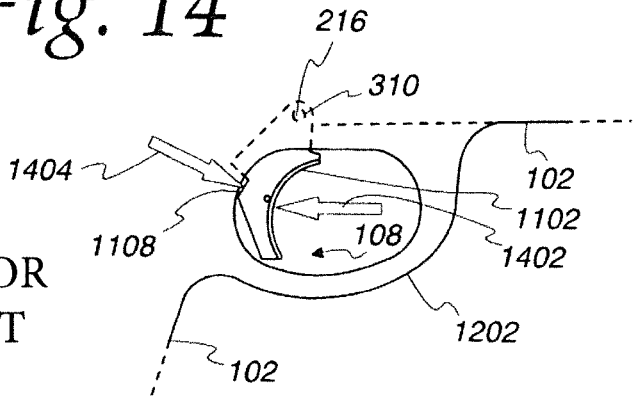
Fig. 14 PRIOR ART
FIG. 14 also illustrates the trigger of FIG. 11 as may be installed in the firearm of FIG. 1 in accordance with various embodiments.

Referring now to FIGS. 12-14, side elevations of a trigger area of the firearm in various stages of operation of the trigger 108 in the firearm 100 in accordance with various embodiments are shown. Shown are a portion of the frame 102, the trigger 108, the trigger bar pin 214, the trigger pin 216, the trigger bar pin opening 308, the forward stop shoulder 1106, the rearward stop shoulder 1108, a trigger guard 1202, a safety block portion 1204, a trigger firing force 1402, and an opposing force 1404.

With continuing reference to FIGS. 12 and 13, operation of the forward stop shoulder 1106 and the rearward stop shoulder 1108 are described. Depicted is the trigger 108 pivotally connected to the frame 102 at the trigger pin 216. The firearm 100 typically comprises a trigger guard 1202 or other guarding means surrounding the trigger 108. FIG. 12 shows the trigger 108 in the safe steady state forward resting position 614, where neither the trigger 108 nor the trigger safety blade 304 is depressed rearward. In this configuration, rearward rotational movement of the trigger 108 about the trigger pin 216 is abated unless rearward force is applied to the trigger safety blade 304 to disengage at least one safety mechanism. By at least one embodiment, the safety mechanism comprises the safety block portion 1204 disposed on the rear portion of the trigger safety blade 304 to abate rearward movement of the trigger 108 by interfering with a portion of the frame 102 of the firearm 100. It should be noted that the trigger profile shown in FIGS. 12-14 is meant to be generally indicative of a trigger profile. In the preferred embodiment the trigger profile is the trigger profile shown in FIG. 11.

FIG. 13 shows proper rearward movement of the trigger 108. As the trigger safety blade 304 is depressed rearward so as to pivot into the safety blade slot 1104, the safety block portion 1204 pivots up and into the slot existing at the rear portion of the trigger 108, thus eliminating the interference and allowing the trigger 108 to travel in the rearward direction. While the trigger 108 is in the forward resting position 614, as is shown in FIG. 12, the forward stop shoulder 1106, being disposed on the front profile of the trigger 108, rests against the portion of the frame 102 to abate forward rotational movement of the trigger 108 about the trigger pin 216. By using the trigger 108 including the forward stop shoulder 1106, the physical location of the forward resting position 614 is altered (as compared to a standard manufactured trigger), and particularly, is repositioned rearward. Because the repositioning has no effect on the physical location of the engagement point 616, this rearwardly repositioned resting position 614 results in a shorter pre-travel travel segment 606. By one embodiment, this shortened pre-travel travel segment 606 distance is no greater than approximately 0.3 inches, and no greater than 0.2 inches by another embodiment.

While the trigger 108 is at the rearward stop point 620 as depicted in FIG. 12, the rearward stop shoulder 1108 interferes with the portion of the frame 102 abating further rearward movement of the trigger 108, in much the same fashion as the safety block portion 1204 described above. By using the trigger 108 including the rearward stop shoulder 1108, the physical location of the rearward stop point 620 is altered (as compared to a standard manufactured trigger), and particularly, is repositioned forward. Because the repositioning has no effect on the physical location of the break point 618 or the reset point 622, the forwardly repositioned rearward stop point 620 results in a shorter over-travel travel segment 610 distance and a shorter reset travel segment 612 distance. By at least one embodiment, the over-travel travel segment 610 comprises a distance of no greater than approximately 0.15 inches, or no greater than 0.1 inches by another embodiment, or no greater than 0.05 inches by an even further embodiment. Further still, by other approaches, the over-travel travel segment 610 distance may be as small as 0.03, 0.025, or even 0.02 inches. Also by at least one embodiment, the reset travel segment 612 comprises a distance of no greater than approximately 0.2 inches, and no greater than approximately 0.13 inches by another embodiment.

Manufacturing tolerances on mass-produced firearms 100 are often less than perfect, which can produce other issues. Particularly, a trigger stop currently utilized on at least one firearm 100 may or may not stop rearward movement of the trigger 108 prior to the trigger bar 212 unintentionally engaging another surface internal to the firearm 100. This premature internal engagement causes the trigger 108 to stop prior to reaching the trigger stop and results in additional longitudinal forces being placed on the trigger bar 212, which are translated to the trigger 108 through the trigger bar pin 214 and trigger bar pin opening 308. As the typical force actually applied to the trigger 108 in firing a firearm 100 can approach 20 pounds, the forces on these components are substantial when the trigger 108 is in its most rearward stopped position. After repeated use in this manner, the trigger bar pin 214 and/or the trigger bar pin opening 308 can become damaged. Particularly, the trigger bar pin 214 can become bent or work its way out of the trigger bar pin opening 308. Additionally, the trigger bar pin opening 308 can enlarge, further allowing the trigger bar pin 214 to "walk out" of the opening 308. In this case, the firearm 100 can become inoperable until further repairs are performed. This can leave a user in an unsafe situation, especially when the firearm 100 is utilized by law enforcement or armed forces personnel. By moving the physical location of the stop point 620 forward through use of the rearward stop shoulder 1108, even the most divergent variations in manufacturing tolerances do not affect these aspects of the firearm 100 as rearward trigger movement is stopped by the rearward stop shoulder 1108 prior to unintentional engagement of the trigger bar 212 or other component with internal surfaces. Thus, damage to the trigger bar pin 214 and opening 308 is avoided as substantially no additional force is exerted on the trigger bar pin 214 or the trigger bar pin opening 308 when a rearward force is applied to the trigger 108 and the rearward stop shoulder 1108 is engaging the frame 102.

Referring again to FIG. 14, an additional benefit of use of the rearward stop shoulder 1108 in accordance with various embodiments is described. Shown in FIG. 14 is the trigger 108 at its rearward stop point 620. Arrow 1402 represents the force applied to the trigger 108 during firing, which often far exceeds the maximum trigger pull weight 626 (typically nearing 20 pounds). This point force 1402 is applied near the center of the front face 1102 of the trigger 108 and is representative of the force of a finger spread across the front face 1102 of the trigger 108. The rearward stop shoulder 1108 is disposed on a rear surface of the trigger 108 and located near and opposite the vertical center of the front face 1102. Thus, the force opposing the applied force 1402 (represented by arrow 1404) originates primarily at rearward stop shoulder 1108 through its interaction with the portion of the frame 102. Any additional opposing force on the trigger pin 216 is greatly exceeded by the forward force 1404 applied to the trigger 108 by the frame 102 at the rearward stop shoulder 1108 and greatly exceeded by the rearward force 1402 applied to the trigger 108 when the rearward stop shoulder 1108 is engaging the frame 102. Additionally, the frame 102 and the rearward stop shoulder 1108 are particularly strong and do not themselves serve other mechanical purposes that would render the firearm 100 useless upon failure.

Referring next to FIGS. 15-18, side elevational views of the sear actuator assembly 408, the trigger bar 212, and the striker block 1000 are shown in various positions during the firing sequence. Shown are the trigger bar 212, the sear 402, the sear actuator 414, the trigger bar contact surface 448, the sear actuator contact surface 706, the striker block contact surface 220, the striker block 1000, the fulcrum axis 704, an at-rest location 1500, a travel location 1600, and a travel distance 1602.

Figure 15:
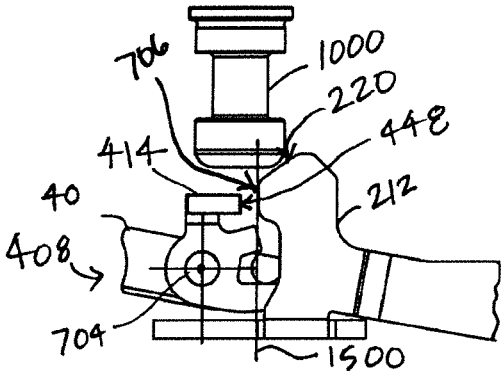
FIG. 15 is a side elevational view of a sear actuator assembly, the striker block and a trigger bar of the firearm when the trigger of the firearm is at rest.

FIG. 15 shows the sear actuator assembly 408, the trigger bar 212, and the striker block 1000 positions when the trigger 108 is at rest, i.e. while the trigger safety blade 304 is unengaged by the user (i.e. forward resting position 614 of FIG. 6). The striker block contact surface 220 of the trigger bar 212 is near to but not in contact with the striker block 1000. The sear actuator contact surface 706 of the trigger bar 212 is near but not in contact with the trigger bar contact surface 448 of the sear actuator 414. The sear 402 is biased forward by the sear spring (not shown). A vertical plane normal to the view and coinciding with the striker block contact surface 220 is defined as the at-rest location 1500.

Figure 16:
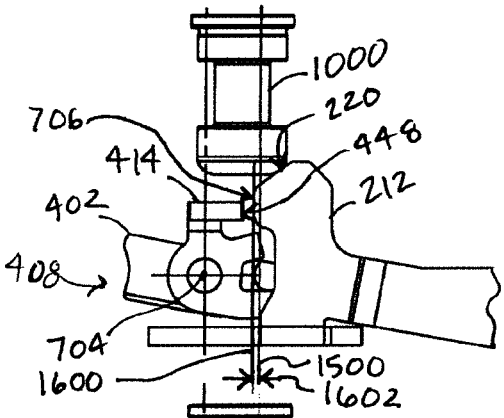
FIG. 16 is a side elevational view the sear actuator assembly, the striker block and the trigger bar of the firearm when the trigger has moved rearward.

Referring next to FIG. 16, the sear actuator assembly 408, the trigger bar 212, and the striker block 1000 positions are shown when the trigger 108 has been engaged and the trigger 108 has moved rearward, contacting the striker block 1000 (i.e. within pre-travel). In response to the user moving the trigger 108 to the rear, the trigger bar 212 and thus the sear contact surface 706 is moved to the rear, as shown by the travel distance 1602 showing the difference between the original at-rest location 1500 and the FIG. 16 travel location 1600 shown in FIG. 16. The difference between the at-rest location 1500 and the travel location 1600 is the travel distance 1602. Also at this point in the firing sequence, the striker block contact surface 220 of the trigger bar 212 has contacted the striker block 1000. The trigger bar 212 has moved towards the sear actuator 414 but has not contacted the sear actuator 414.

Figure 17:
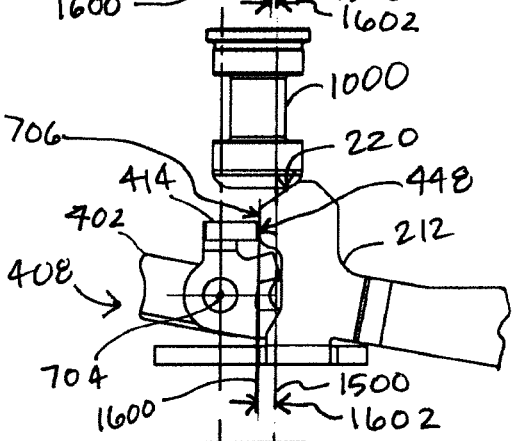
FIG. 17 is a side elevational view the sear actuator assembly, the striker block and the trigger bar of the firearm when the trigger bar has contacted the sear actuator assembly.

Referring next to FIG. 17, the sear actuator assembly 408, the trigger bar 212, and the striker block 1000 positions are shown when the trigger bar 212 has moved rearward sufficiently to contact the sear actuator 414 (i.e. the engagement point 616). In response to the continues movement of the trigger 108 rearward, the trigger bar 212 has moved further rearward, as shown by the increased travel distance in FIG. 17 as compared to the travel distance of FIG. 16. As the trigger bar 212 has traveled rearwards, the striker block 1000 has been pushed upwards as previously described. The trigger bar 212 has moved backwards sufficiently to initially contact the sear actuator 414.

Referring next to FIG. 18, the sear actuator assembly 408, the trigger bar 212, and the striker block 1000 positions are shown when the trigger bar 212 has engaged and rotated the sear actuator 414 and sear 402 until the sear 402 releases the striker depending leg 206, firing the cartridge (i.e. the break point 618).

In FIG. 18, the trigger bar 212 has continued to move rearwards in response to movement of the trigger. The trigger bar 212 as a result has pushed against the trigger bar contact surface 448 of the sear actuator 414, rotating the sear actuator 414 about the fulcrum 412, which in turn engages and rotates the sear 402 about the fulcrum 412 as previously described. In the sear position of FIG. 18, the sear 402 has rotated enough for it to release the striker, resulting in firing of the firearm. the striker block 1000 has been pushed further upwards as previously described. The travel distance 1602 has reached a maximum length in FIG. 18.

Referring again to FIGS. 15-18, the sear actuator 414 including the trigger engagement leg 446 accomplishes two significant improvements on the trigger pull of the single action striker-firearm. Firstly, the length 464 of the trigger engagement leg 446 allows for the short travel distance 1602 required for the trigger bar 212 to come into contact with the sear actuator 414, as shown in FIG. 17. The shortened travel distance 1602 results in a shorter trigger pull. Secondly, the lengthening of the trigger engagement leg 446 locates the point of contact between the trigger bar 212 and the sear actuator 414 (the trigger bar engagement point 708) at a greater distance from the fulcrum axis 704, resulting in a longer lever arm, whereby the force required to pull the trigger 108 is lessened.

It is understood that this disclosure contemplates a firearm 100 manufactured with any number of the above described components (including, but not limited to the sear 402, the sear spring 404, the sear spring plunger 436, the trigger 108, the trigger return spring 302, the trigger pin 216, the trigger bar pin 214, the trigger safety blade 304, the trigger safety blade pin 306, the trigger safety blade spring, the striker block 1000, and the striker block spring). Additionally, this disclosure contemplates a method of modifying a firearm 100, being modified by a factory, a dealer, or an individual, to replace any number of factory standard components or previously altered components with any number of the above described components. Additionally still, this disclosure contemplates assembly, distribution, sales, or otherwise providing of one or more parts kits comprising any number of the above described components. Additionally even still, this disclosure contemplates installation of any number of the above described components into a firearm 100.

Though other applications may exist, this disclosure is ideally suited for use with an M&P® M2.0™ series of semiautomatic handguns produced by SMITH & WESSON®.

While the invention herein disclosed has been described by means of specific embodiments, examples and applications thereof, numerous modifications and variations could be made thereto by those skilled in the art without departing from the scope of the invention set forth in the claims.

What is claimed is:

1. A firing mechanism for a firearm comprising:

a trigger pivotally coupled to a frame of the firearm and biased in a forward longitudinal direction, the trigger comprising:

a rearward stop shoulder comprising a generally rearward-facing hump in a rear profile of the trigger, the rearward stop shoulder configured to stop further rearward movement of the trigger by the rearward stop shoulder contacting a portion the frame whereby the stopping of further rearward movement of the trigger limits an over-travel distance of the trigger to no greater than 0.15 inches;

a trigger bar biased in a forward longitudinal direction and pivotally connected to the trigger, whereby actuating the trigger in a rearward direction transmits rearward longitudinal movement to the trigger bar, the trigger bar including a generally vertical trigger bar sear contact surface;

a sear assembly comprising:

a body having a sear fulcrum opening configured to receive a fulcrum body of the firearm having a fulcrum axis about which the sear is pivotal between at least a ready pivotal position and a firing pivotal position; and a trigger engagement leg extending from the body and including a generally vertical trigger leg engagement face configured for engagement by the trigger bar sear contact surface when the trigger bar is moved rearward, wherein the sear is rotated about the fulcrum axis when the trigger leg engagement face is engaged by the trigger bar sear contact surface, wherein a radius from a trigger bar engagement point on an outer edge of the trigger leg engagement face to the fulcrum axis is at least 0.23 inches.

2. The firing mechanism for the firearm of claim 1, wherein the trigger is configured for a SMITH & WESSON® M&P® M2.0™ semiautomatic handgun.

3. The firing mechanism for the firearm of claim 1, wherein the sear assembly is configured for a SMITH & WESSON® M&P® M2.0™ semiautomatic handgun.

4. The firing mechanism for the firearm of claim 1, the firing mechanism further comprising a sear spring having a sear spring weight, wherein the sear assembly is further configured to result in a trigger pull weight portion attributable to the sear assembly between about 1.9 pounds and about 2.4 pounds when the sear spring weight is between about 0.9 pounds and about 1.7 pounds.

5. The firing mechanism for the firearm of claim 1, the firing mechanism further comprising a sear spring having a sear spring weight, wherein the sear assembly is further configured to result in a trigger pull weight portion attributable to the sear assembly between about 1.4 pounds and about 1.9 pounds when a sear spring weight is between about 0.3 pounds and about 0.95 pounds.

* * * * *